US011866280B2

(12) United States Patent
Hirai

(10) Patent No.: US 11,866,280 B2
(45) Date of Patent: Jan. 9, 2024

(54) DOCUMENT FEEDER

(71) Applicant: PFU Limited, Ishikawa (JP)

(72) Inventor: Yoshito Hirai, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 275 days.

(21) Appl. No.: 17/180,490

(22) Filed: Feb. 19, 2021

(65) Prior Publication Data

US 2021/0171301 A1 Jun. 10, 2021

Related U.S. Application Data

(63) Continuation of application No. PCT/JP2018/034698, filed on Sep. 19, 2018.

(51) Int. Cl.
*B65H 3/08* (2006.01)
*B65H 3/14* (2006.01)
*B65H 5/06* (2006.01)

(52) U.S. Cl.
CPC ..... *B65H 3/14* (2013.01); *B65H 3/0816* (2013.01); *B65H 5/062* (2013.01); *B65H 2701/11232* (2013.01); *B65H 2701/18272* (2013.01)

(58) Field of Classification Search
CPC .... B65H 2701/1123; B65H 2701/1827; B65H 47/00
See application file for complete search history.

(56) References Cited

U.S. PATENT DOCUMENTS 5,478,066 A * 12/1995 Yoshida ..... B65H 3/128 271/99
6,015,145 A * 1/2000 Hartel ..... B65H 3/48 271/106

FOREIGN PATENT DOCUMENTS

| | | | |
|---|---|---|---|
| JP | H09-258496 | A | 10/1997 |
| JP | H09-304977 | A | 11/1997 |
| JP | 2008-174372 | A | 7/2008 |
| JP | 2010-215351 | A | 9/2010 |

OTHER PUBLICATIONS

International Search Report issued in corresponding International Patent Application No. PCT/JP2018/034698, dated Nov. 6, 2018, with English translation.

* cited by examiner

*Primary Examiner* — Howard J Sanders
(74) *Attorney, Agent, or Firm* — Rimon, P.C.

(57) ABSTRACT

A document feeder includes a document placement member that has a placement surface, a sucker that has a suction surface on which a part of a document placed on the placement surface is sucked and sucks air from a space formed between the document placement member and the suction surface, a blower that blows air into the space, and a paper feeder that conveys the document in a conveyance direction along the placement surface, wherein the suction surface is inclined relative to the placement surface such that the space is narrower toward the upstream side in the conveyance direction.

7 Claims, 23 Drawing Sheets

DOCUMENT FEEDER

CROSS-REFERENCE TO RELATED APPLICATION

This application is a continuation of International Application No. PCT/JP2018/034698, filed on Sep. 19, 2018, the entire contents of which are incorporated herein by reference.

FIELD

The embodiments discussed herein are related to a document feeder.

BACKGROUND

A document feeder that automatically unfolds and conveys a Z-folded document folded in a Z shape is known (refer to Japanese Laid-open Patent Publication No. 2008-174372, Japanese Laid-open Patent Publication No. 09-258496, and Japanese Laid-open Patent Publication No. 09-304977).

Unfortunately, such a document feeder may significantly deform a portion other than a crease and buckle a Z-folded document when unfolding and conveying the Z-folded document.

SUMMARY

According to an aspect of an embodiment, a document feeder includes a document placement member that has a placement surface, a sucker that has a suction surface on which a part of a document placed on the placement surface is sucked and sucks air from a space formed between the document placement member and the suction surface, a blower that blows air into the space, and a paper feeder that conveys the document in a conveyance direction along the placement surface, wherein the suction surface is inclined relative to the placement surface such that the space is narrower toward the upstream side in the conveyance direction.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Preferred embodiments of the disclosure will be explained with reference to accompanying drawings. A document feeder according to embodiments disclosed by the subject application will be described below with reference to the drawings. It should be noted that the present disclosure is not limited by the following description. In the following description, the same constituent elements are denoted by the same reference signs and an overlapping description will be omitted.

First Embodiment

Figure 1:
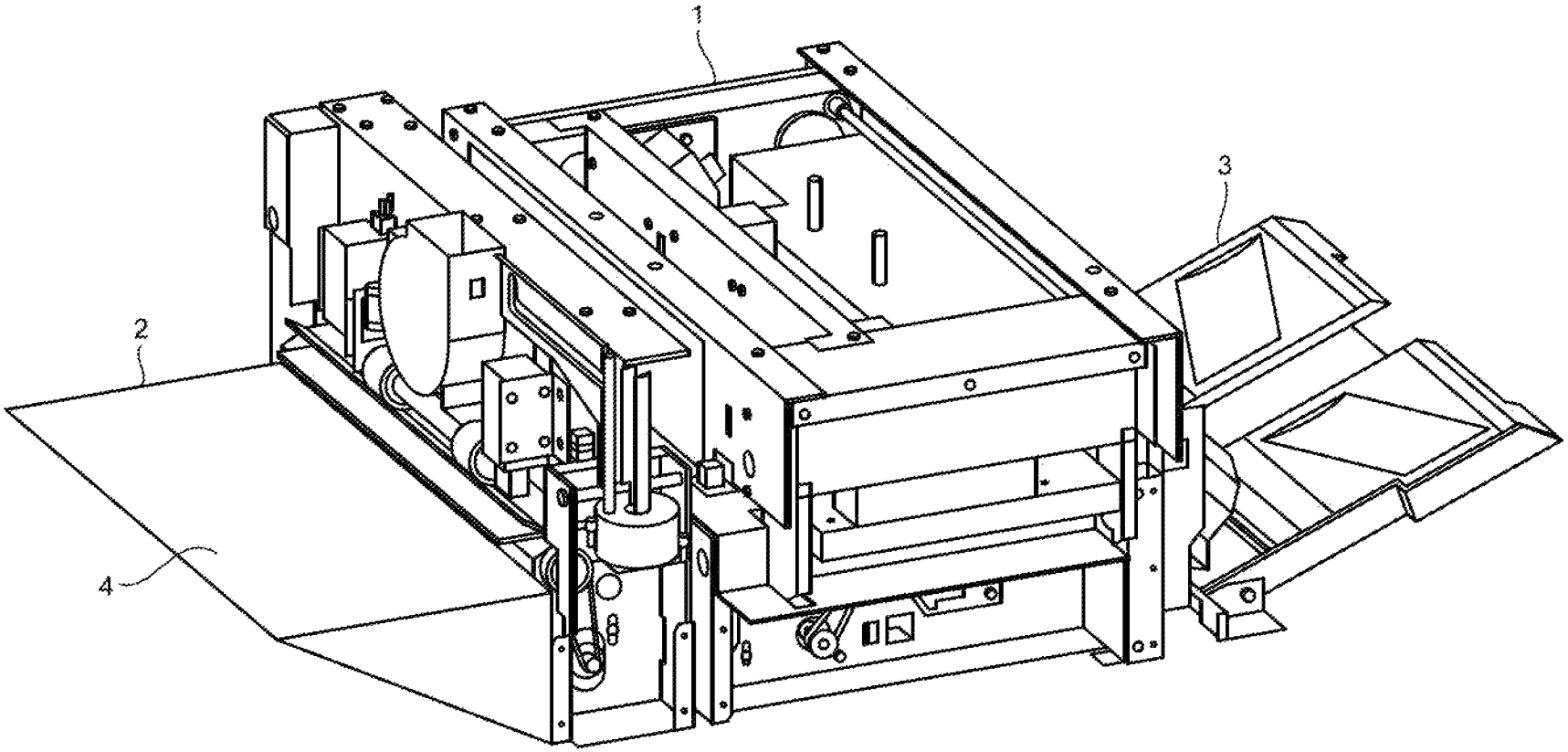
FIG. 1 is a perspective view illustrating an image reading apparatus provided with a document feeder in a first embodiment.

A document feeder in a first embodiment is used in an image reading apparatus 10 as illustrated in FIG. 1. FIG. 1 is a perspective view illustrating the image reading apparatus 10 provided with the document feeder in the first embodiment. The image reading apparatus 10 includes an image reading apparatus body 1, a platen 2, and an exit tray 3. The platen 2 has a placement surface 4, on which a document is placed. The placement surface 4 is substantially flat and substantially parallel to a plane along an installation surface on which the image reading apparatus 10 is installed.

Figure 2:
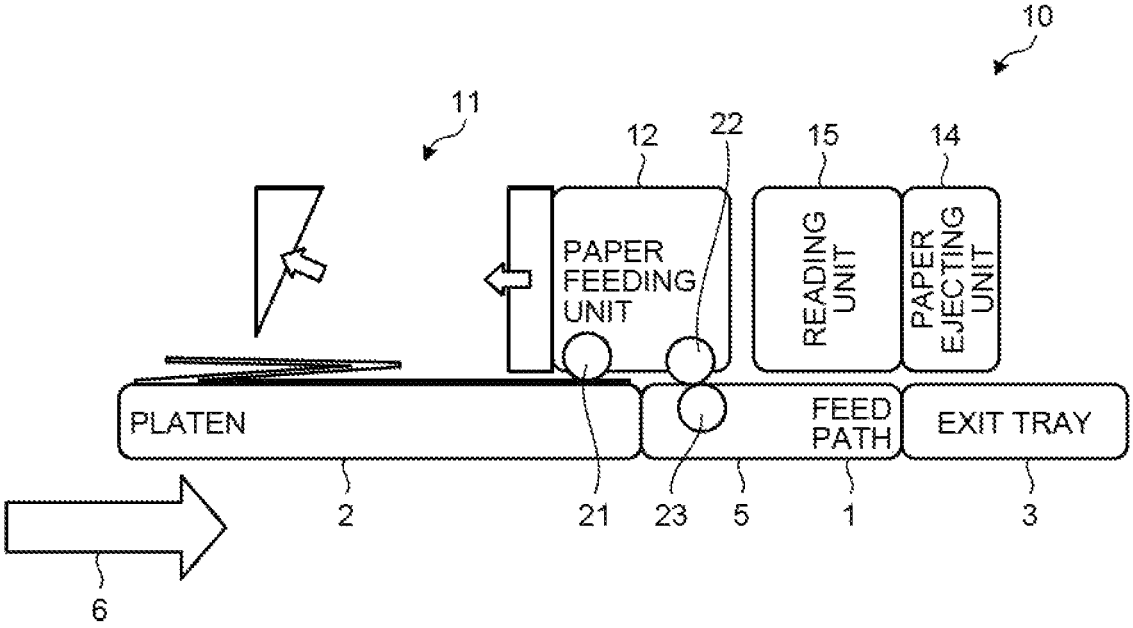
FIG. 2 is a side view schematically illustrating the image reading apparatus provided with the document feeder in the first embodiment.

FIG. 2 is a side view schematically illustrating the image reading apparatus 10 provided with the document feeder in the first embodiment. The image reading apparatus body 1 has a feed path 5. The feed path 5 is disposed between the platen 2 and the exit tray 3 to form a path connecting the platen 2 to the exit tray 3. The exit tray 3 is disposed on the downstream side in a conveyance direction 6 from the platen 2. The conveyance direction 6 is substantially parallel to a plane along the installation surface on which the image reading apparatus 10 is installed. The feed path 5 guides a document released onto the feed path 5 such that the document released onto the feed path 5 is conveyed to the downstream side in the conveyance direction 6 along the path.

The image reading apparatus 10 further includes an unfolding unit 11, a paper feeding unit 12, a paper ejecting unit 14, and a reading unit 15. The unfolding unit 11 is disposed above the platen 2. When a document placed on the platen 2 is folded, the unfolding unit 11 unfolds the document substantially flat. The paper feeding unit 12 is disposed at an end on the platen 2 side of the feed path 5. The paper feeding unit 12 includes a pick roller 21, a separation roller 22, and a brake roller 23.

The pick roller 21 is formed in a cylindrical shape and disposed above the platen 2. The pick roller 21 is switched between a load mode and a distant mode. When switched to the load mode, the pick roller 21 comes closer to the feed path 5 so as to come into contact with a document placed on the platen 2 and rotates forward (counterclockwise in FIG. 2) to release the document in contact with the pick roller 21, among a plurality of documents placed on the platen 2, to the feed path 5 and bring the document released onto the feed path 5 into contact with the separation roller 22. When switched to the distant mode, the pick roller 21 retracts from the platen 2 so as not to come into contact with the document placed on the platen 2. The separation roller 22 is formed in a cylindrical shape and disposed on the downstream side in the conveyance direction 6 of the pick roller 21 above the feed path 5. The separation roller 22 rotates forward (counterclockwise in FIG. 2) to convey the document in contact with the separation roller 22 to the downstream side in the conveyance direction 6.

The brake roller 23 is disposed on the underside of the feed path 5 and disposed on the underside of the separation roller 22 so as to be in contact with the separation roller 22. The brake roller 23 follows the separation roller 22 to rotate forward (clockwise in FIG. 2) when the separation roller 22 is rotating forward and a document is not sandwiched between the separation roller 22 and the brake roller 23. When the documents are sandwiched between the separation roller 22 and the brake roller 23, the brake roller 23 rotates backward (counterclockwise in FIG. 2) to convey a document not in contact with the separation roller 22, among the documents, to the upstream side in the conveyance direction 6. When being in contact with a document conveyed by the separation roller 22, the brake roller 23 follows the document conveyed by the separation roller 22 to rotate forward.

The paper ejecting unit 14 is disposed at an end on the exit tray 3 side of the feed path 5, that is, disposed on the downstream side of the paper feeding unit 12 on the feed path 5. The paper ejecting unit 14 places a document supplied from the paper feeding unit 12 onto the exit tray 3. The reading unit 15 is disposed between the paper feeding unit 12 and the paper ejecting unit 14 on the feed path 5. The reading unit 15 reads images on both surfaces of a document conveyed between the paper feeding unit 12 and the paper ejecting unit 14 on the feed path 5.

Figure 3:
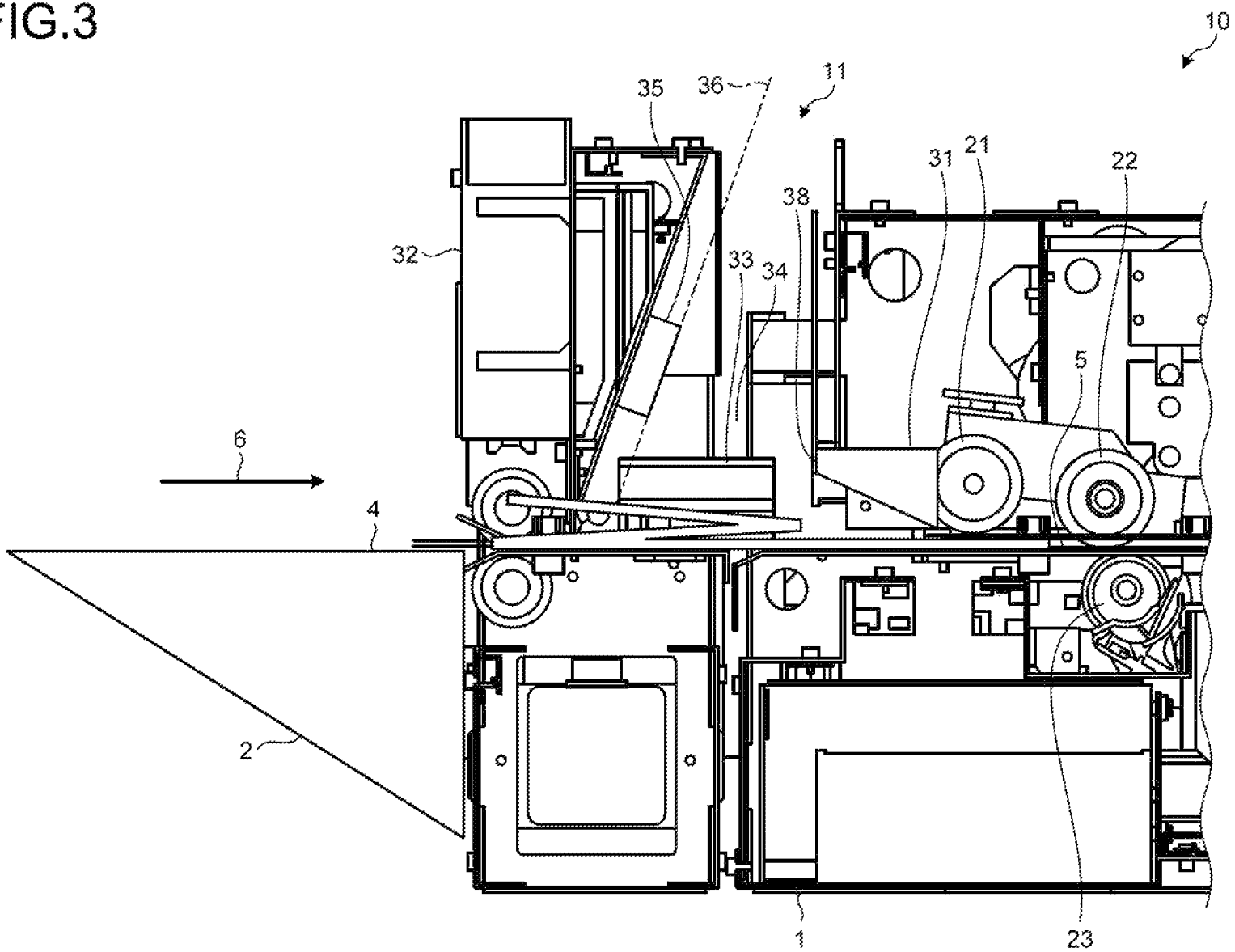
FIG. 3 is a cross-sectional view illustrating an unfolding unit of the document feeder in the first embodiment.

FIG. 3 is a cross-sectional view illustrating the unfolding unit 11 of the document feeder in the first embodiment. The unfolding unit 11 includes a lifting blower 31, a suction blower 32, and a pair of side blowers 33. The lifting blower 31 has a downstream air-flow opening 38 on the downstream side in the conveyance direction 6 of an unfolding space 34 between the lifting blower 31 and the suction blower 32 above the platen 2 and blows the air into the unfolding space 34 through the downstream air-flow opening. The suction blower 32 has a plurality of air intakes 35 formed along a flat suction surface 36. The suction surface 36 is oriented obliquely downward and inclined relative to the conveyance direction 6 so as to go further away from the feed path 5 toward the downstream side in the conveyance direction 6. That is, the unfolding space 34 is formed such that it is narrower toward the upstream side in the conveyance direction 6. The suction surface 36 is parallel to the width direction. The width direction is parallel to a plane along the installation surface on which the image reading apparatus 10 is installed, and is normal to the conveyance direction 6. The angle between the plane along the placement surface 4 and the suction surface 36 is equal to a predetermined angle included in a range of 60 degrees or more to less than 90 degrees. The suction blower 32 sucks the air from the unfolding space 34 through the air intakes 35. A pair of side blowers 33 are disposed on both sides in the width direction of the unfolding space 34 and blows the air into the unfolding space 34 from both sides in the width direction of the unfolding space 34.

The unfolding unit 11 further includes a not-illustrated document detection sensor. The document detection sensor detects whether a document is placed on the platen 2.

Figure 4:
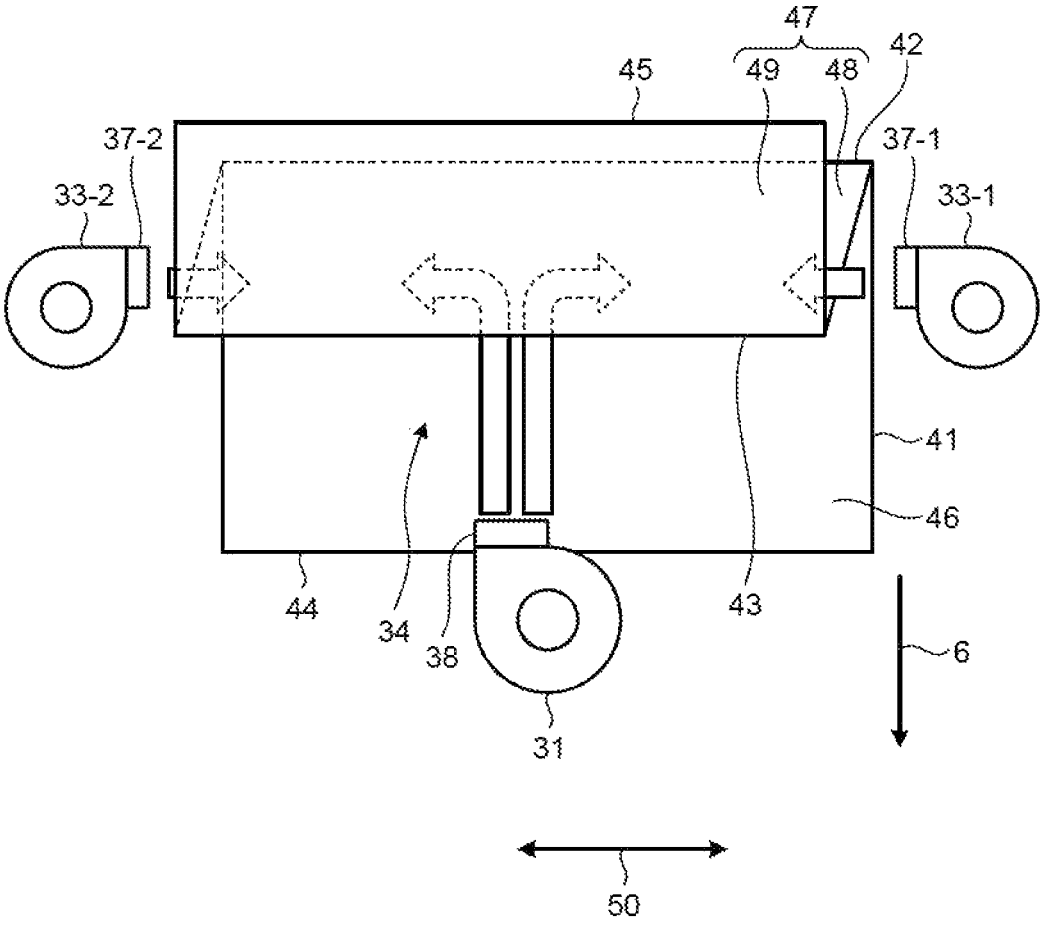
FIG. 4 is a plan view illustrating a Z-folded document placed on a platen of the document feeder in the first embodiment.

A Z-folded document 41 placed on the platen 2 of the document feeder in the first embodiment is formed from a sheet of paper and has a first crease 42 and a second crease 43, as illustrated in FIG. 4. FIG. 4 is a plan view illustrating the Z-folded document 41 placed on the platen 2 of the document feeder in the first embodiment. The first crease 42 is formed along another straight line substantially parallel to a straight line along a front end 44, substantially at the center between the front end 44 and a back end 45 of the Z-folded document 41. The second crease 43 is formed along another straight line substantially parallel to a straight line along the first crease 42, substantially at the center between the first crease 42 and the back end 45. The second crease 43 is folded in the opposite direction to the first crease 42 and, for example, is a valley fold when the first crease 42 is a mountain fold.

The Z-folded document 41 includes a front end portion 46 and a folded portion 47. The front end portion 46 is a portion between the front end 44 and the first crease 42 of the Z-folded document 41. The folded portion 47 is a portion between the first crease 42 and the back end 45 of the Z-folded document 41. The folded portion 47 includes a first folded portion 48 and a second folded portion 49. The first folded portion 48 is a portion between the first crease 42 and the second crease 43 of the Z-folded document 41. The second folded portion 49 is a portion between the second crease 43 and the back end 45 of the Z-folded document 41.

When the Z-folded document 41 is folded in this way, a part of the Z-folded document 41 is not exposed to the outside. The part includes a portion of the front end portion 46 that is covered by the first folded portion 48, a portion of the first folded portion 48 that is covered by the front end portion 46, a portion of the first folded portion 48 that is covered by the second folded portion 49, and a portion of the second folded portion 49 that is covered by the first folded portion 48.

The Z-folded document 41 is placed on the platen 2 such that the folded portion 47 is disposed above the front end portion 46, that is, such that the front end portion 46 is disposed between the platen 2 and the folded portion 47. The folded portion 47 is disposed in the unfolding space 34 when the Z-folded document 41 is placed on the platen 2.

A pair of side blowers 33 includes a first side blower 33-1 and a second side blower 33-2. The first side blower 33-1 includes a first side air-flow opening 37-1 disposed on one side in a width direction 50 of the unfolding space 34 and blows the air toward the unfolding space 34 through this first side air-flow opening 37-1. The second side blower 33-2 includes a second side air-flow opening 37-2 disposed on the other side opposite to the one side in the width direction 50 of the unfolding space 34 and blows the air toward the unfolding space 34 through this second side air-flow opening 37-2.

When the Z-folded document 41 is placed on the platen 2, the Z-folded document 41 is disposed such that an end surface on one side in the width direction 50 of the folded portion 47 faces the first side blower 33-1, an end surface on the other side in the width direction 50 of the folded portion 47 faces the second side blower 33-2, and the second crease 43 faces the lifting blower 31.

The image reading apparatus 10 further includes a not-illustrated control unit. The control unit is a computer and includes a central processing unit (CPU), a storage device, an input/output device, a communication interface, and a media interface. The CPU executes a computer program installed in the control unit to perform information processing and controls the storage device, the input/output device, the communication interface, and the media interface. The CPU executes a computer program installed in the control unit to further control each element provided in the image reading apparatus 10. Examples of the storage device include a memory such as RAM and ROM, a fixed disk device such as hard disk, and a solid state drive (SSD). The storage device stores a computer program installed in the control unit and stores information used by the CPU. The input/output device outputs information generated through operation by the user to the CPU and outputs information generated by the CPU so that the user can recognize the information.

The communication interface is controlled by the CPU to download information to the control unit from another computer connected through a communication line and transmit information from the control unit to another computer. The media interface is formed such that a non-transitory tangible recording medium can be loaded thereto. Examples of the recording medium include a semiconductor memory, a magnetic disk, a magneto-optical disk, and an optical disk. When a recording medium is loaded, the media interface is controlled by the CPU to read information from the recording medium and record information on the recording medium. The computer program installed in the control unit may be the one downloaded from another computer through the communication interface or the one read from a recording medium through the media interface.

Operation of Image Reading Apparatus 10

Figure 5:
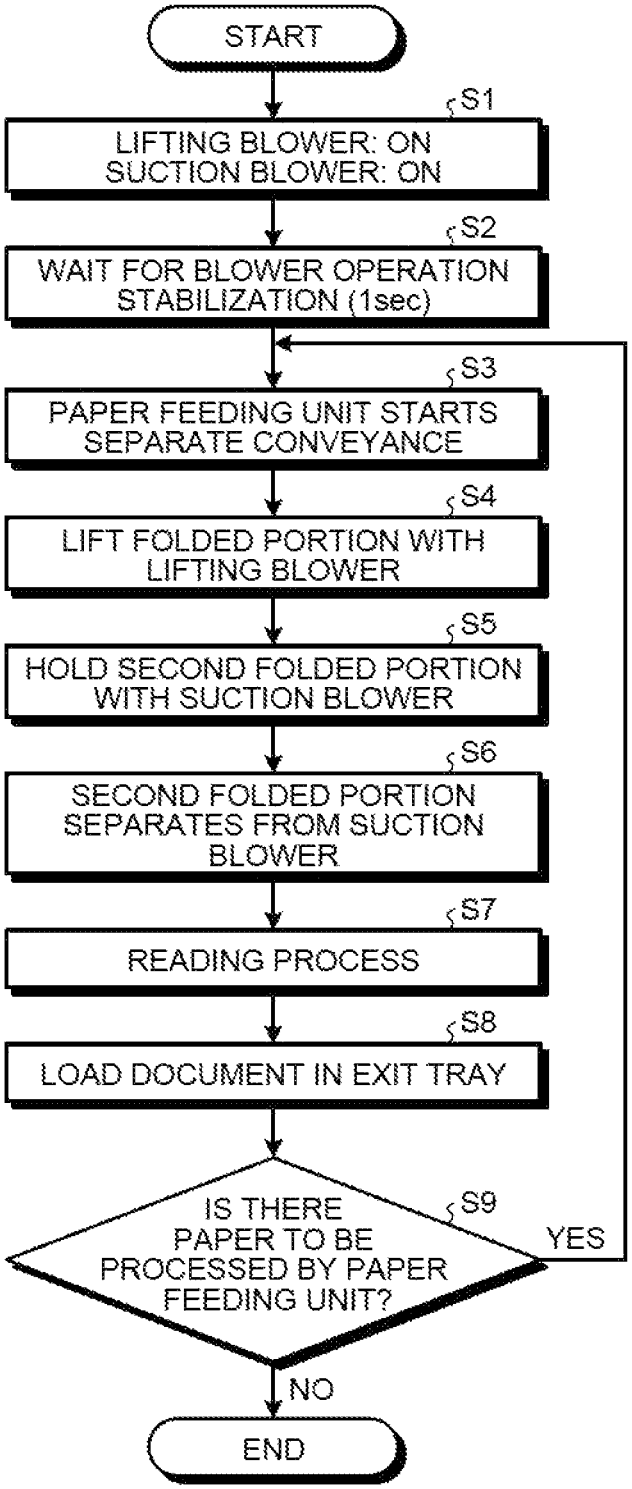
FIG. 5 is a flowchart illustrating the operation of the image reading apparatus provided with the document feeder in the first embodiment.

FIG. 5 is a flowchart illustrating the operation of the image reading apparatus 10 provided with the document feeder in the first embodiment. To read an image from a plurality of documents using the image reading apparatus 10, the user places the documents on the platen 2 and operates the input/output device of the control unit to start the image reading apparatus 10. The documents placed on the platen 2 include the Z-folded document 41. Upon starting of the image reading apparatus 10, the control unit controls the lifting blower 31 to blow the air into the unfolding space 34, controls the suction blower 32 to suck the air from the unfolding space 34, and controls a pair of side blowers 33 to blow the air into the unfolding space 34 from both sides in the width direction 50 (step S1).

The control unit waits until a timing after a predetermined period has passed since the timing when the lifting blower 31, the suction blower 32, and a pair of side blowers 33 start operation (step S2). The predetermined period is, for example, one second. With passage of a predetermined period, the lifting blower 31 can stably blow the air into the unfolding space 34. With passage of a predetermined period, the suction blower 32 can stably suck the air from the unfolding space 34. With passage of a predetermined period, a pair of side blowers 33 can stably blow the air into the unfolding space 34.

After a predetermined period has passed, the control unit starts separate conveyance (step S3). When separate conveyance is started, the control unit switches the pick roller 21 from a retraction mode to a load mode. The pick roller 21, switched from the retraction mode to the load mode, comes into contact with a document disposed on the top among the documents placed on the platen 2. The control unit allows the pick roller 21 to rotate forward to bring a document in contact with the pick roller 21, among the documents placed on the platen 2, into contact with the separation roller 22. The control unit allows the separation roller 22 to rotate forward to supply the document in contact with the separation roller 22 to the paper ejecting unit 14. The control unit allows the brake roller 23 to rotate backward to convey a document not in contact with the separation roller 22, among the documents sandwiched between the separation roller 22 and the brake roller 23, to the upstream side in the conveyance direction 6.

Figure 6:
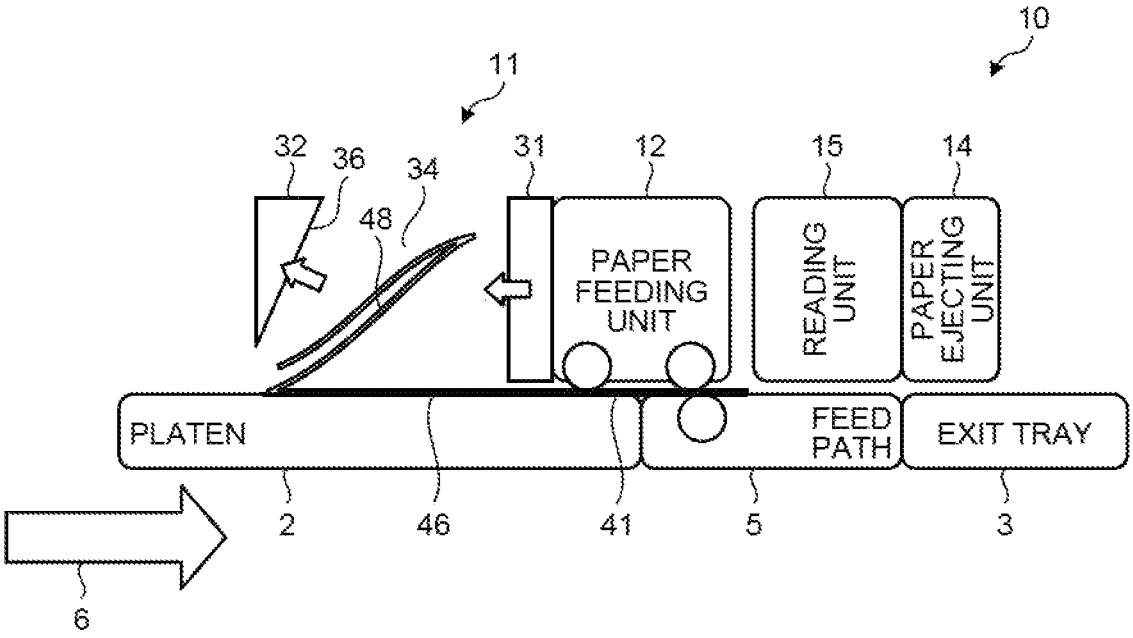
FIG. 6 is a side view schematically illustrating the unfolding unit of the document feeder in the first embodiment when air is blown in between a front end portion and a first folded portion of the Z-folded document.

The unfolding unit 11 unfolds the Z-folded document 41 when the Z-folded document 41 is conveyed by the paper feeding unit 12 to the downstream side in the conveyance direction 6. That is, the Z-folded document 41 is conveyed by the paper feeding unit 12 to the downstream side in the conveyance direction 6, whereby the folded portion 47 of the Z-folded document 41 is disposed in the unfolding space 34. When the folded portion 47 of the Z-folded document 41 is disposed in the unfolding space 34, as illustrated in FIG. 6, the air is blown into the unfolding space 34 from the lifting blower 31, whereby the air is blown in between the front end portion 46 and the first folded portion 48. FIG. 6 is a side view schematically illustrating the unfolding unit 11 of the document feeder in the first embodiment when air is blown in between the front end portion 46 and the first folded portion 48 of the Z-folded document 41. The air is blown into the unfolding space 34 from a pair of side blowers 33, whereby the air is further blown in between the front end portion 46 and the first folded portion 48 of the Z-folded document 41. The air blown in between the front end portion 46 and the first folded portion 48 lifts the folded portion 47 of the Z-folded document 41 from the front end portion 46 (step S4).

Figure 7:
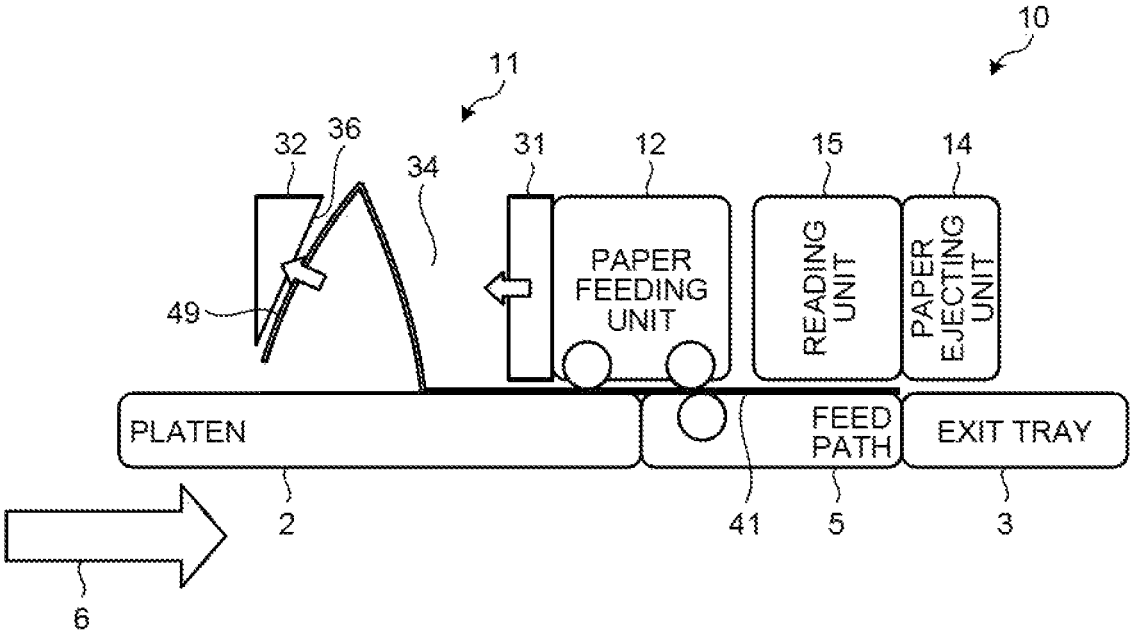
FIG. 7 is a side view schematically illustrating the unfolding unit of the document feeder in the first embodiment when a second folded portion of the Z-folded document is held by a suction blower.

Since the suction blower 32 sucks the air from the unfolding space 34, as illustrated in FIG. 7, the second folded portion 49 is pulled to the suction surface 36 when the folded portion 47 of the Z-folded document 41 lifts from the front end portion 46. After being pulled to the suction surface 36, the second folded portion 49 of the Z-folded document 41 is held by the suction blower 32 along the suction surface 36 (step S5). FIG. 7 is a side view schematically illustrating the unfolding unit 11 of the document feeder in the first embodiment when the second folded portion 49 of the Z-folded document 41 is held by the suction blower 32.

Figure 8:
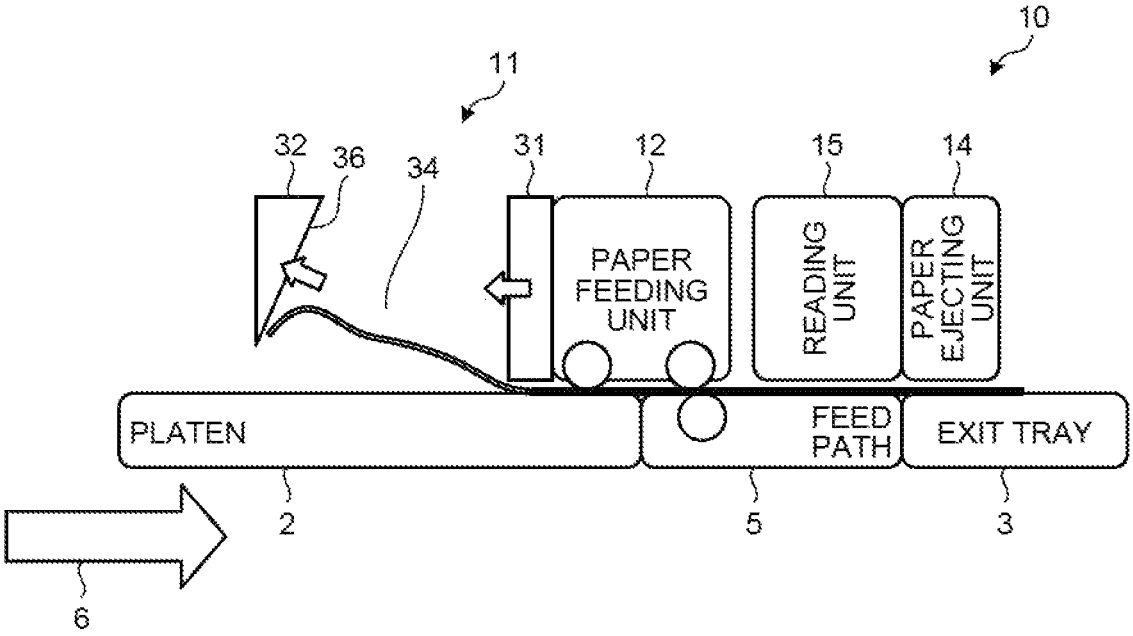
FIG. 8 is a side view schematically illustrating the unfolding unit of the document feeder in the first embodiment when the second folded portion of the Z-folded document separates from a suction surface.

After being held by the suction blower 32, the second folded portion 49 of the Z-folded document 41 separates from the suction surface 36 as the Z-folded document 41 is further conveyed by the paper feeding unit 12 to the downstream side in the conveyance direction 6 (step S6). FIG. 8 is a side view schematically illustrating the unfolding unit 11 of the document feeder in the first embodiment when the second folded portion 49 of the Z-folded document 41 separates from the suction surface 36. The second folded portion 49 of the Z-folded document 41 separates from the suction surface 36, whereby the Z-folded document 41 is unfolded substantially flat. At this moment, the Z-folded document 41 is unfolded such that a portion other than the first crease 42 and the second crease 43 is not heavily deformed since the suction surface 36 is inclined at a predetermined angle relative to a plane along the placement surface 4. Buckling of the Z-folded document 41 is prevented since a portion other than the first crease 42 and the second crease 43 is not heavily deformed during unfolding. The unfolded Z-folded document 41 is supplied to the paper ejecting unit 14 by the paper feeding unit 12.

When a document is supplied from the paper feeding unit 12 to the paper ejecting unit 14, the control unit controls the reading unit 15 to read images on both surfaces of the document conveyed from the paper feeding unit 12 to the paper ejecting unit 14 and records the read images (step S7). At this moment, since the Z-folded document 41 is unfolded, the reading unit 15 can read an image of a portion not exposed to the outside when the Z-folded document 41 is folded and can read images on both surfaces of the unfolded Z-folded document 41. The control unit controls the paper ejecting unit 14 to place the document supplied from the brake roller 23 to the paper ejecting unit 14 onto the exit tray 3 (step S8).

The control unit controls the document detection sensor of the unfolding unit 11 to detect whether a document is placed on the platen 2 (step S9). The control unit repeatedly performs the process from step S3 to step S9 until the document detection sensor detects that no document is placed on the platen 2 (No at step S9). The image reading apparatus 10 performs such an operation to read each of images of the documents placed on the platen 2.

The image reading apparatus 10 unfolds and conveys the Z-folded document 41 but also can unfold and convey a folded document other than a Z-folded document. Examples of the folded document include a double-folded document, an accordion-folded document, and an inside-folded document.

Figure 9:
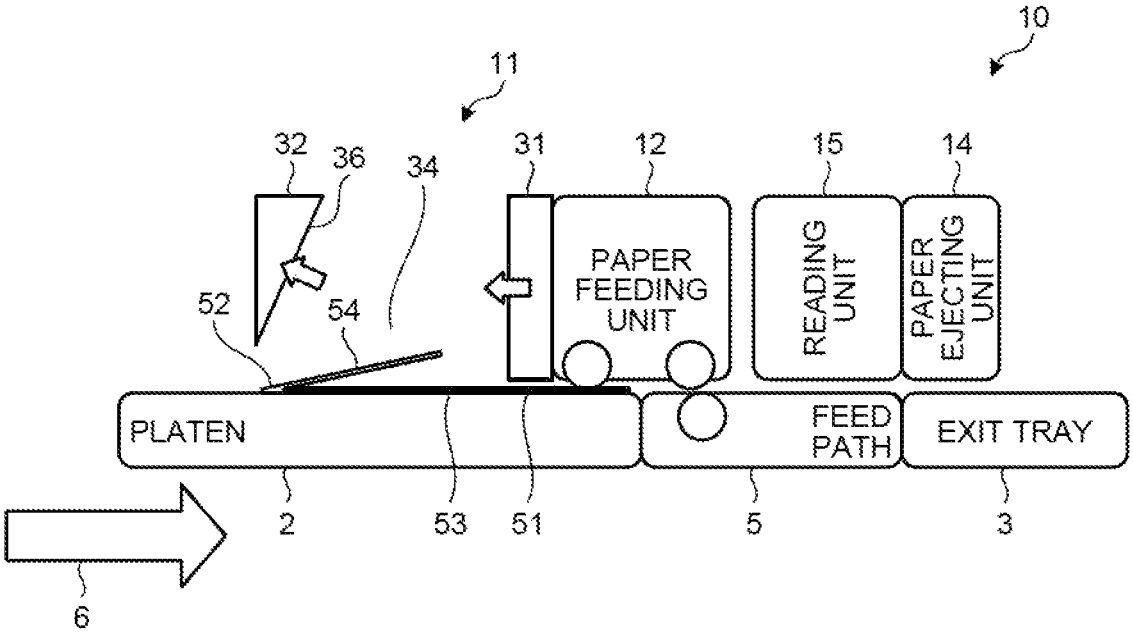
FIG. 9 is a side view schematically illustrating the unfolding unit of the document feeder in the first embodiment when air is blown in between a front end portion and a folded portion of a double-folded document.

As illustrated in FIG. 9, a double-folded document 51 has a crease 52 and includes a front end portion 53 and a folded portion 54. FIG. 9 is a side view schematically illustrating the unfolding unit 11 of the document feeder in the first embodiment when air is blown in between the front end portion 53 and the folded portion 54 of the double-folded document 51. When the folded portion 54 of the double-folded document 51 is disposed in the unfolding space 34, the air is blown into the unfolding space 34 from the lifting blower 31, whereby the air is blown in between the front end portion 53 and the folded portion 54. The air is blown into the unfolding space 34 from a pair of side blowers 33, whereby the air is further blown in between the front end portion 53 and the folded portion 54 of the double-folded document 51. The air blown in between the front end portion 53 and the folded portion 54 lifts the folded portion 54 of the double-folded document 51 from the front end portion 53.

Figure 10:
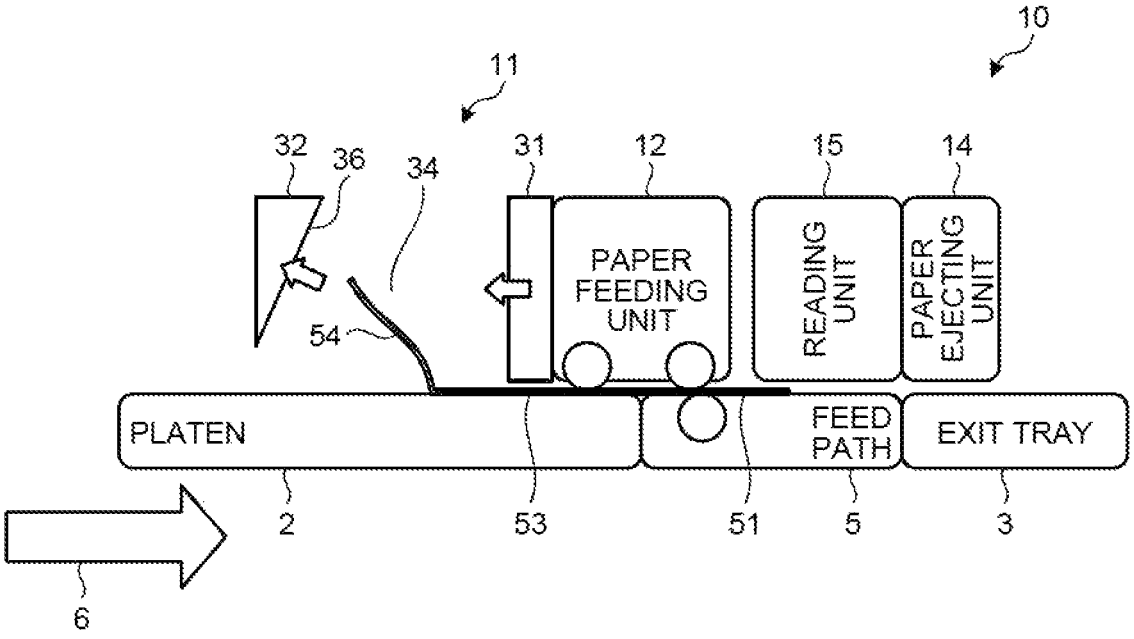
FIG. 10 is a side view schematically illustrating the unfolding unit of the document feeder in the first embodiment when the folded portion of the double-folded document separates from the suction surface.
Figure 11:
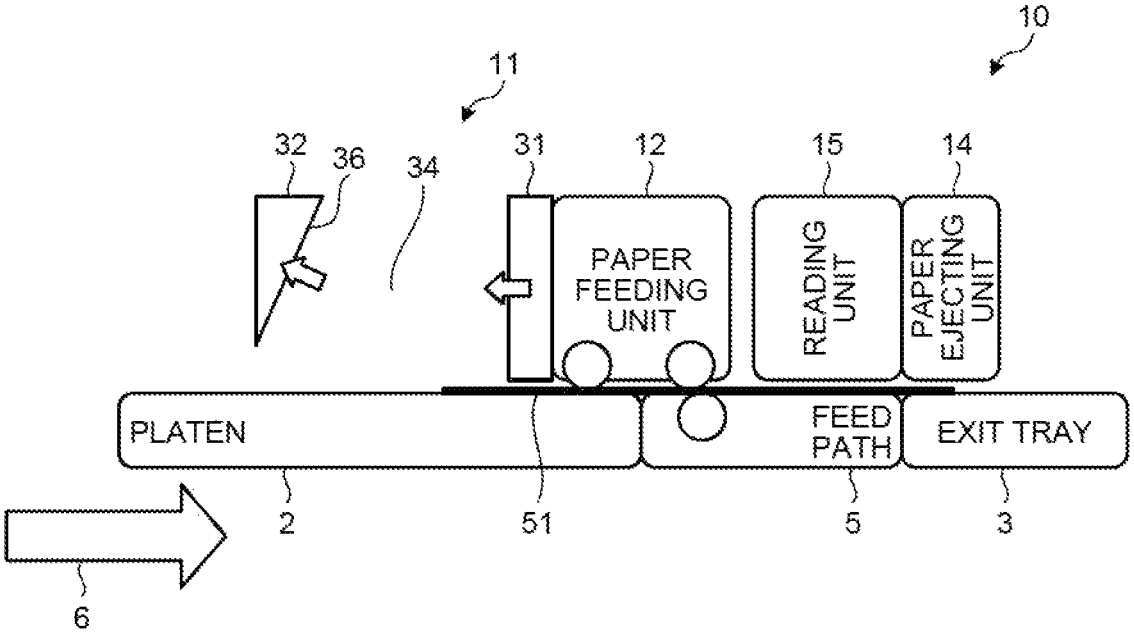
FIG. 11 is a side view schematically illustrating the unfolding unit of the document feeder in the first embodiment when the double-folded document is unfolded.

Since the suction blower 32 sucks the air from the unfolding space 34, the folded portion 54 of the double-folded document 51 is held along the suction surface 36 by the suction blower 32 when being lifted from the front end portion 53. After being held by the suction blower 32, the folded portion 54 of the double-folded document 51 separates from the suction surface 36 as the double-folded document 51 is further conveyed by the paper feeding unit 12 to the downstream side in the conveyance direction 6, as illustrated in FIG. 10. FIG. 10 is a side view schematically illustrating the unfolding unit 11 of the document feeder in the first embodiment when the folded portion 54 of the double-folded document 51 separates from the suction surface 36. The folded portion 54 of the double-folded document 51 separates from the suction surface 36, whereby the double-folded document 51 is unfolded substantially flat, as illustrated in FIG. 11. FIG. 11 is a side view schematically illustrating the unfolding unit 11 of the document feeder in the first embodiment when the double-folded document 51 is unfolded. The image reading apparatus 10 can prevent buckling of the double-folded document 51 by appropriately unfolding the double-folded document 51 without heavily deforming a portion other than the crease 52, in the same manner as the Z-folded document 41.

Figure 12:
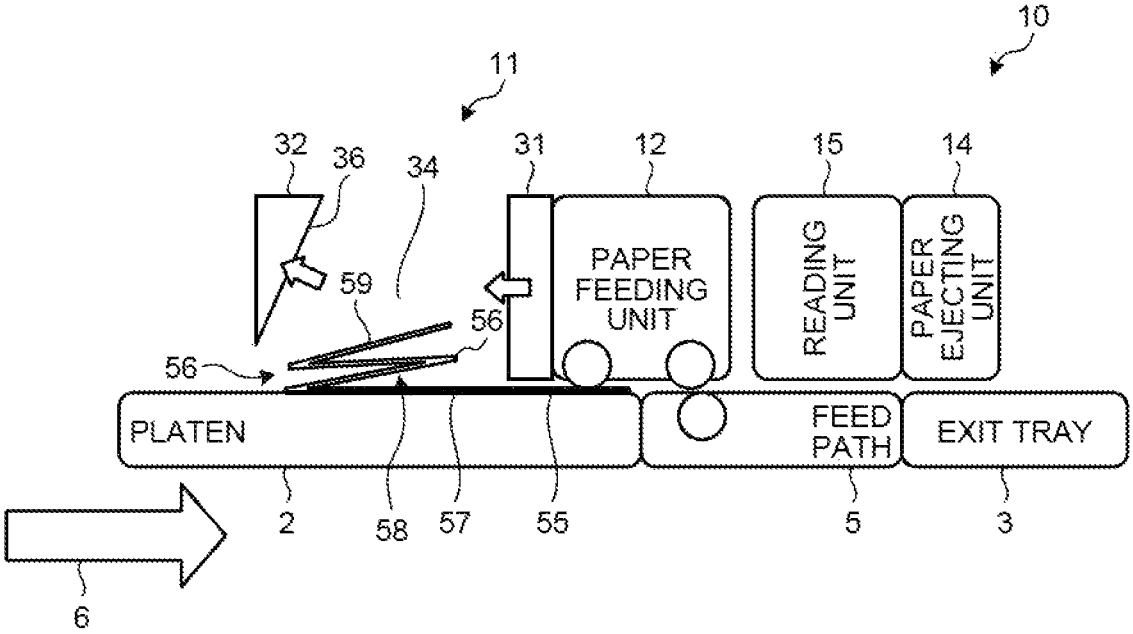
FIG. 12 is a side view schematically illustrating the unfolding unit of the document feeder in the first embodiment when air is blown in between a front end portion and a plurality of folded portions of an accordion-folded document.

As illustrated in FIG. 12, an accordion-folded document 55 has a plurality of creases 56 and includes a front end portion 57 and a plurality of folded portions 58. FIG. 12 is a side view schematically illustrating the unfolding unit 11 of the document feeder in the first embodiment when air is blown in between the front end portion 57 and the folded portions 58 of the accordion-folded document 55. The creases 56 include a plurality of valley folds and mountain folds alternately formed. That is, when the creases 56 include two valley folds, a mountain fold is formed between the two valley folds, and when the creases 56 include two mountain folds, a valley fold is formed between the two mountain folds.

When the folded portions 58 of the accordion-folded document 55 are disposed in the unfolding space 34, the air is blown into the unfolding space 34 from the lifting blower 31, whereby the air is blown in between the front end portion 57 and the folded portions 58. The air is blown into the unfolding space 34 from a pair of side blowers 33, whereby the air is further blown in between the front end portion 57 and the folded portion 58 of the accordion-folded document 55. The air blown in between the front end portion 57 and the folded portions 58 lifts the folded portions 58 of the accordion-folded document 55 from the front end portion 57.

Figure 13:
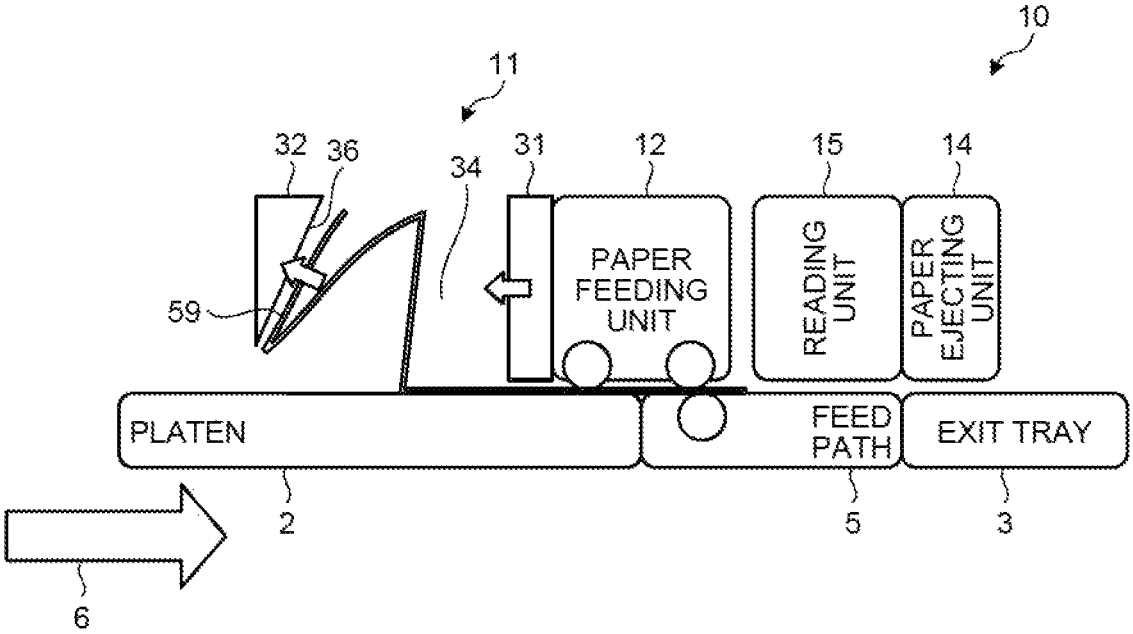
FIG. 13 is a side view schematically illustrating the unfolding unit of the document feeder in the first embodiment when a back-end folded portion of the accordion-folded document is held by the suction blower.

Since the suction blower 32 sucks the air from the unfolding space 34, a back-end folded portion 59 of the accordion-folded document 55 is held by the suction blower 32 when the folded portions 58 are lifted from the front end portion 57, as illustrated in FIG. 13. FIG. 13 is a side view schematically illustrating the unfolding unit 11 of the document feeder in the first embodiment when the back-end folded portion 59 of the accordion-folded document 55 is held by the suction blower 32. The back-end folded portion 59 is one folded portion that forms the back end among the folded portions 58.

Figure 14:
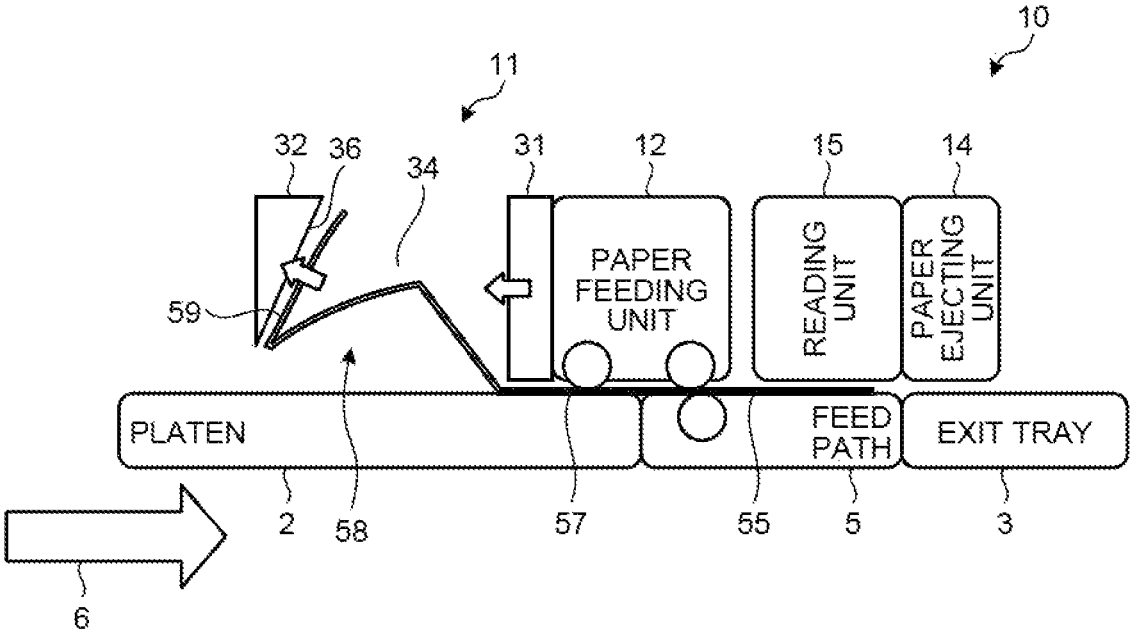
FIG. 14 is a side view schematically illustrating the unfolding unit of the document feeder in the first embodiment when the folded portions of the accordion-folded document are unfolded.

After the back-end folded portion 59 of the accordion-folded document 55 is held by the suction blower 32, the accordion-folded document 55 is conveyed by the paper feeding unit 12 to the downstream side in the conveyance direction 6, whereby the folded portions 58 are unfolded, as illustrated in FIG. 14. FIG. 14 is a side view schematically illustrating the unfolding unit 11 of the document feeder in the first embodiment when the folded portions 58 of the accordion-folded document 55 are unfolded.

Figure 15:
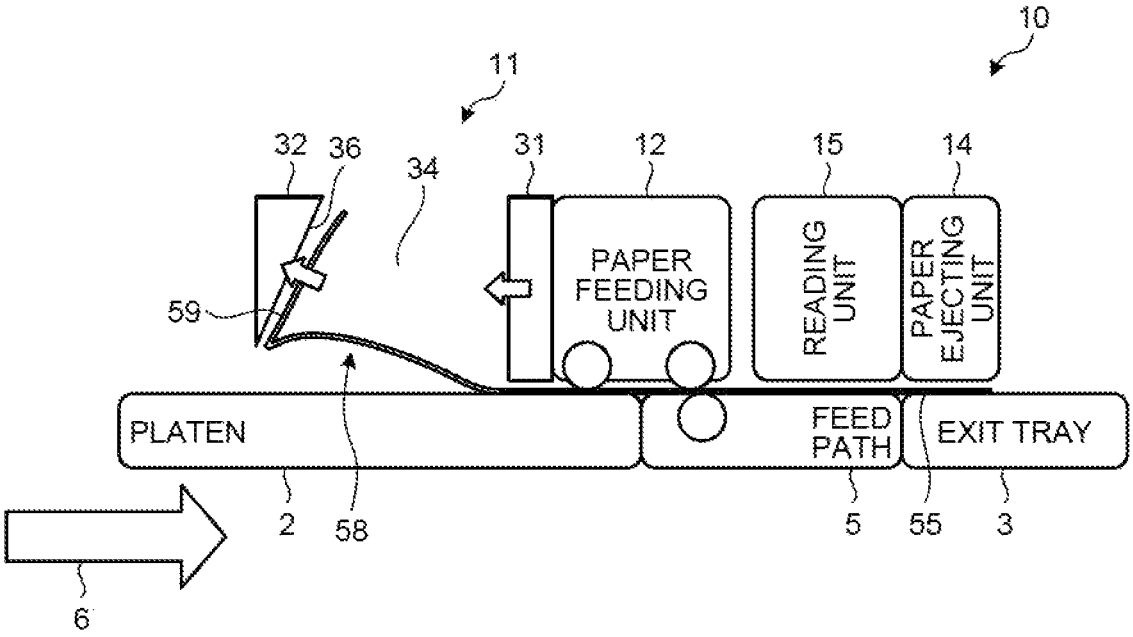
FIG. 15 is a side view schematically illustrating the unfolding unit of the document feeder in the first embodiment when the portions excluding the back-end folded portion among the folded portions are unfolded.

The accordion-folded document 55 is further conveyed by the paper feeding unit 12 to the downstream side in the conveyance direction 6, whereby the portions excluding the back-end folded portion 59 among the folded portions 58 of the accordion-folded document 55 are unfolded, as illustrated in FIG. 15. FIG. 15 is a side view schematically illustrating the unfolding unit 11 of the document feeder in the first embodiment when the portions excluding the back-end folded portion 59 among the folded portions 58 are unfolded.

Figure 16:
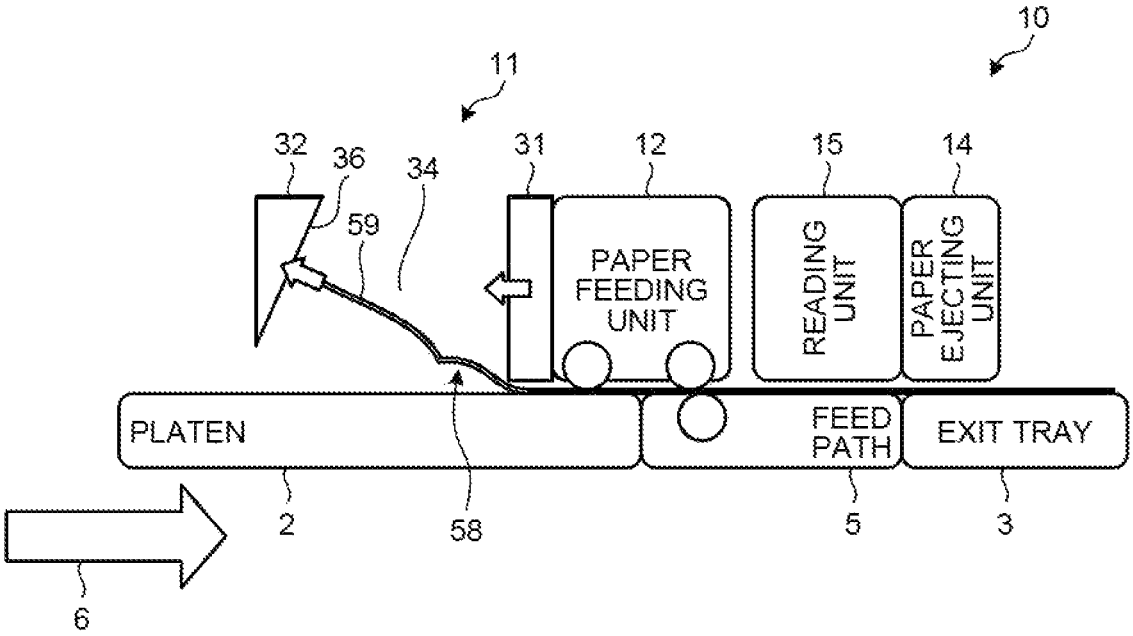
FIG. 16 is a side view schematically illustrating the unfolding unit of the document feeder in the first embodiment when the back-end folded portion of the accordion-folded document separates from the suction surface.

After the portions excluding the back-end folded portion 59 among the folded portions 58 are unfolded, the back-end folded portion 59 of the accordion-folded document 55 separates from the suction surface 36 as the accordion-folded document 55 is further conveyed by the paper feeding unit 12 to the downstream side in the conveyance direction 6, as illustrated in FIG. 16. FIG. 16 is a side view schematically illustrating the unfolding unit 11 of the document feeder in the first embodiment when the back-end folded portion 59 of the accordion-folded document 55 separates from the suction surface 36. The back-end folded portion 59 separates from the suction surface 36, whereby the accordion-folded document 55 is unfolded substantially flat. The image reading apparatus 10 can prevent buckling of the accordion-folded document 55 by appropriately unfolding the accordion-folded document 55 without heavily deforming a portion other than the creases 56, in the same manner as the Z-folded document 41.

Figure 17:
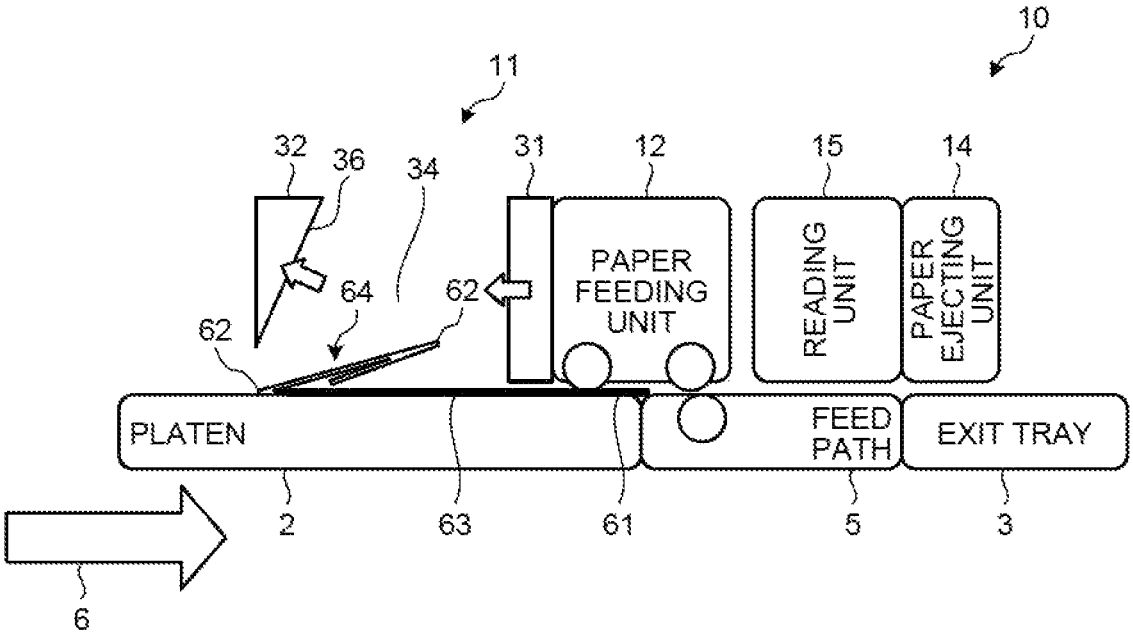
FIG. 17 is a side view schematically illustrating the unfolding unit of the document feeder in the first embodiment when air is blown in between a front end portion and a plurality of folded portions of an inside-folded document.

As illustrated in FIG. 17, an inside-folded document 61 has a plurality of creases 62 and includes a front end portion 63 and a plurality of folded portions 64. FIG. 17 is a side view schematically illustrating the unfolding unit 11 of the document feeder in the first embodiment when air is blown in between the front end portion 63 and the folded portions 64 of the inside-folded document 61. The creases 56 are formed starting from a valley fold. When the folded portions 64 of the inside-folded document 61 are disposed in the unfolding space 34, the air is blown into the unfolding space 34 from the lifting blower 31, whereby the air is blown in between the front end portion 63 and the folded portions 64. The air is blown into the unfolding space 34 from a pair of side blowers 33, whereby the air is further blown in between the front end portion 63 and the folded portions 64 of the inside-folded document 61. The air blown in between the front end portion 63 and the folded portions 64 lifts the folded portions 64 of the inside-folded document 61 from the front end portion 63.

Figure 18:
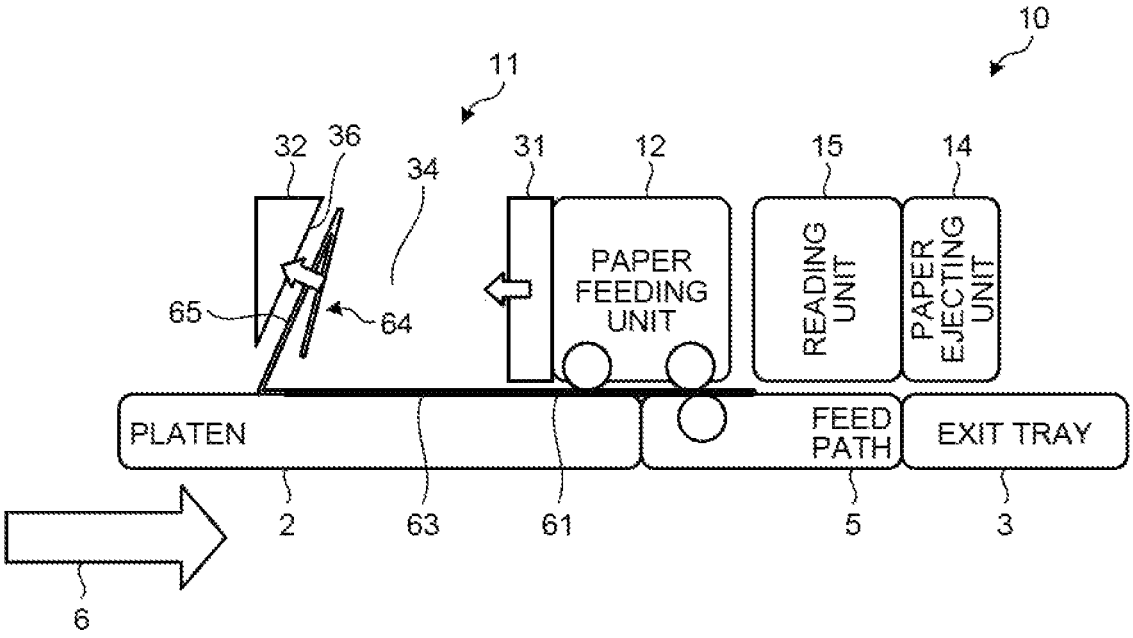
FIG. 18 is a side view schematically illustrating the unfolding unit of the document feeder in the first embodiment when the folded portions of the inside-folded document are held by the suction blower.

Since the suction blower 32 sucks the air from the unfolding space 34, the folded portions 64 of the inside-folded document 61 are held by the suction blower 32 when being lifted from the front end portion 63, as illustrated in FIG. 18. FIG. 18 is a side view schematically illustrating the unfolding unit 11 of the document feeder in the first embodiment when the folded portions 64 of the inside-folded document 61 are held by the suction blower 32.

Figure 19:
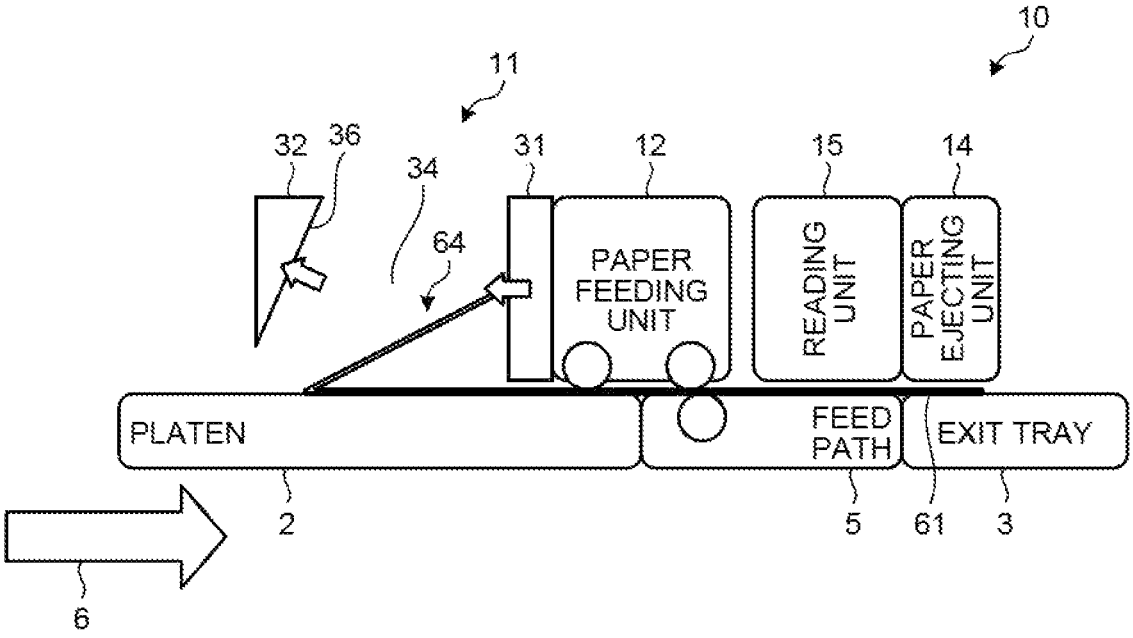
FIG. 19 is a side view schematically illustrating the unfolding unit of the document feeder in the first embodiment when one folded portion among the folded portions of the inside-folded document separates from the suction blower.

After being held by the suction blower 32, one folded portion among the folded portions 64 of the inside-folded document 61 separates from the suction surface 36 as the inside-folded document 61 is conveyed by the paper feeding unit 12 to the downstream side in the conveyance direction 6, as illustrated in FIG. 19. FIG. 19 is a side view schematically illustrating the unfolding unit 11 of the document feeder in the first embodiment when one folded portion among the folded portions 64 of the inside-folded document 61 separates from the suction blower 32.

The air is blown into the unfolding space 34 when one folded portion of the inside-folded document 61 separates from the suction blower 32, whereby a folded portion on the back end side of one folded portion among the folded portions 64 is lifted from the one folded portion. Since the suction blower 32 sucks the air from the unfolding space 34, the folded portion on the back end side of the inside-folded document 61 is held by the suction blower 32 when it is lifted. In this way, each of the folded portions 64 is held by the suction blower 32 and separates from the suction blower 32, whereby the folded portions 64 of the inside-folded document 61 are unfolded.

Figure 20:
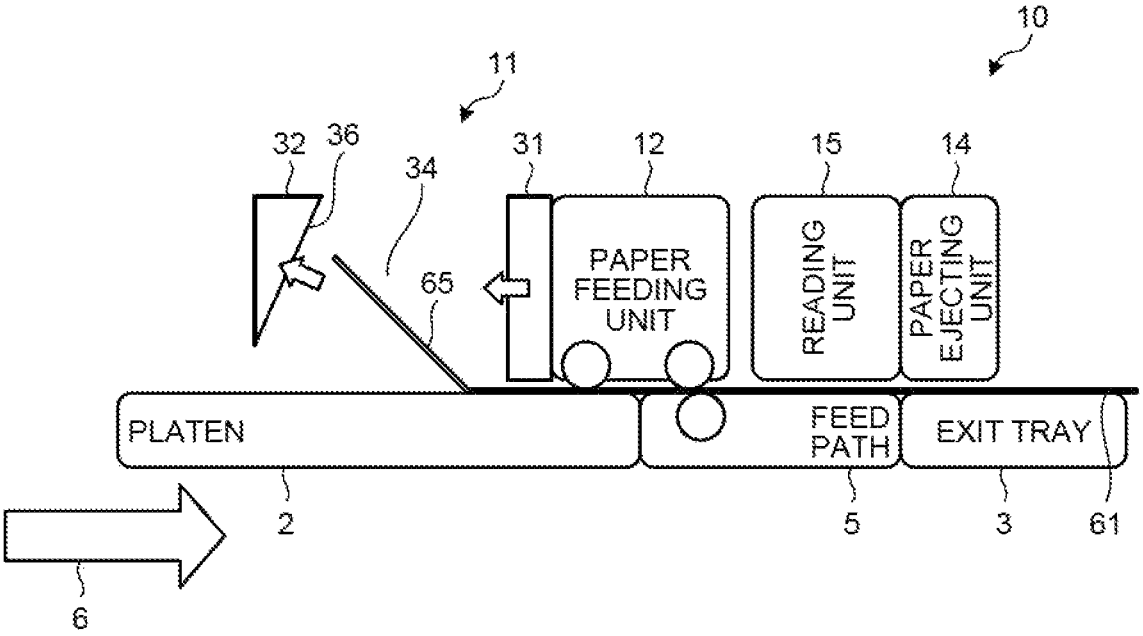
FIG. 20 is a side view schematically illustrating the unfolding unit of the document feeder in the first embodiment when a back-end folded portion of the inside-folded document separates from the suction blower.

A folded portion 65 forming the back end among the folded portions 64 of the inside-folded document 61 is held by the suction blower 32 and thereafter separates from the suction blower 32 as the inside-folded document 61 is conveyed by the paper feeding unit 12 to the downstream side in the conveyance direction 6. FIG. 20 is a side view schematically illustrating the unfolding unit 11 of the document feeder in the first embodiment when the back-end folded portion 65 of the inside-folded document 61 separates from the suction blower 32. The back-end folded portion 65 separates from the suction surface 36, whereby the inside-folded document 61 is unfolded substantially flat. The image reading apparatus 10 can prevent buckling of the inside-folded document 61 by appropriately unfolding the inside-folded document 61 without heavily deforming a portion other than the creases 62, in the same manner as the Z-folded document 41.

The image reading apparatus 10 unfolds a sheet of a folded document having crease(s) but can also unfold a plurality of sheets of folded documents in which a plurality of sheets of paper are folded in an overlapping state. An example of the folded documents is a plurality of sheets of Z-folded documents.

Figure 21:
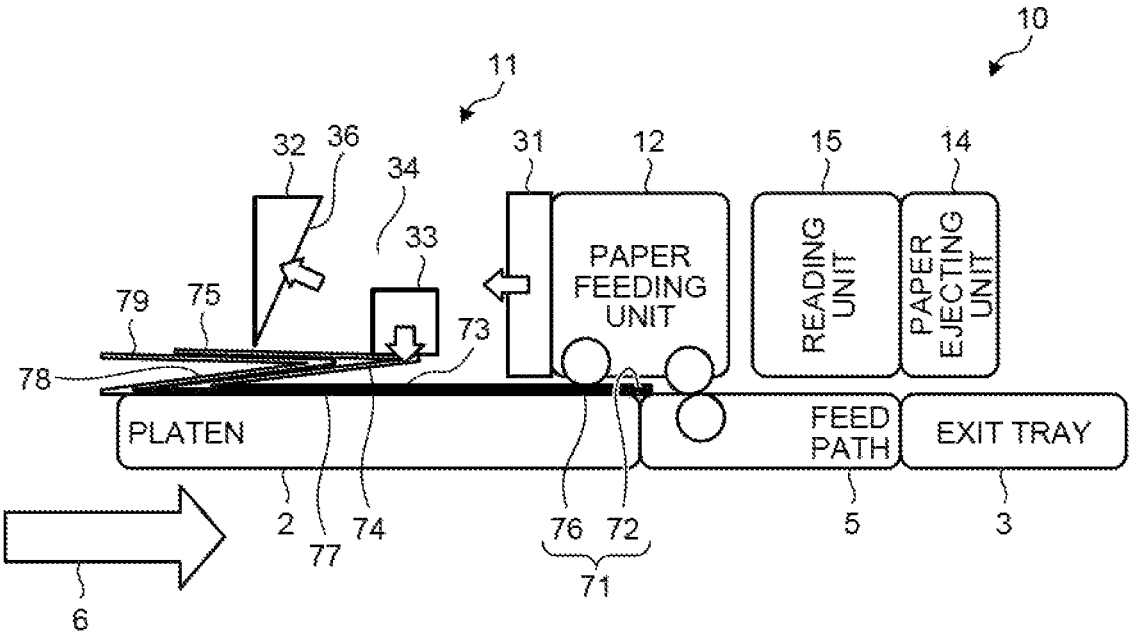
FIG. 21 is a side view schematically illustrating the unfolding unit of the document feeder in the first embodiment when a plurality of sheets of Z-folded documents are placed on the platen.

As illustrated in FIG. 21, among a plurality of sheets of Z-folded documents 71, a Z-folded document 72 on the top has two creases and includes a front end portion 73, a first folded portion 74, and a second folded portion 75, in the same manner as the Z-folded document 41. FIG. 21 is a side view schematically illustrating the unfolding unit 11 of the document feeder in the first embodiment when the sheets of Z-folded documents 71 are placed on the platen 2. Among the sheets of Z-folded documents 71, a plurality of Z-folded documents 76 different from the Z-folded document 72 each have two creases and include a front end portion 77, a first folded portion 78, and a second folded portion 79, in the same manner as the Z-folded document 72. The front end portion 77 overlaps the front end portion 73, the first folded portion 78 overlaps the first folded portion 74, and the second folded portion 79 overlaps the second folded portion 75.

Figure 22:
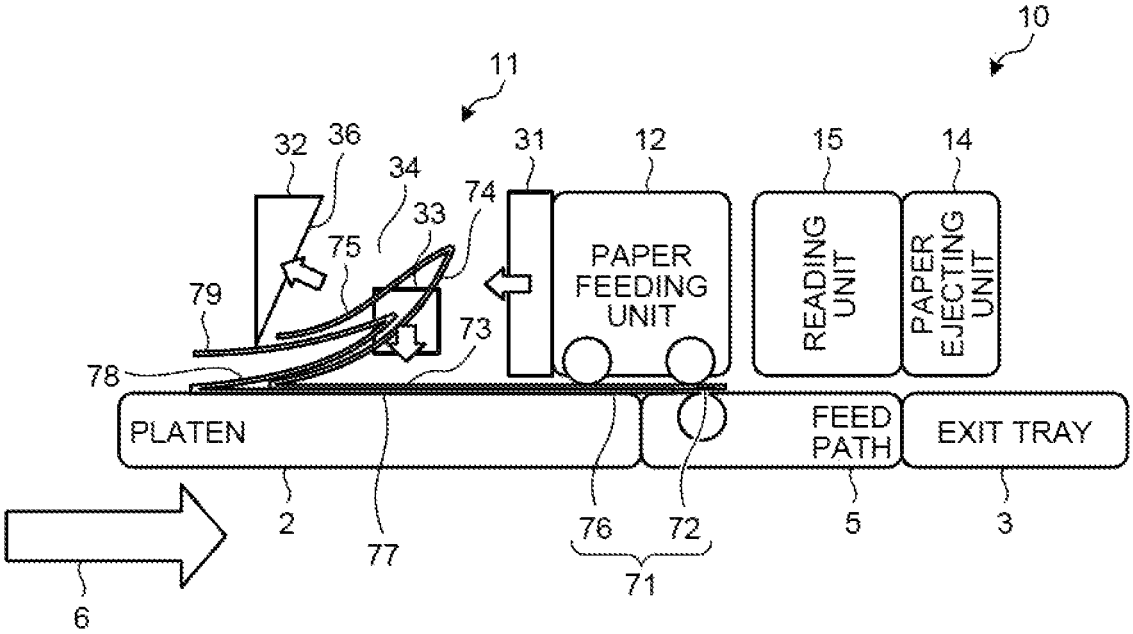
FIG. 22 is a side view schematically illustrating the unfolding unit of the document feeder in the first embodiment when air is blown in between the front end portion and the first folded portion of the sheets of Z-folded documents.

The air is blown from the lifting blower 31 into the unfolding space 34, whereby the air is blown in between the front end portion 73 and the first folded portion 74 of the sheets of Z-folded documents 71, and the second folded portion 75 is lifted from the front end portion 73, as illustrated in FIG. 22. FIG. 22 is a side view schematically illustrating the unfolding unit 11 of the document feeder in the first embodiment when air is blown in between the front end portion 73 and the first folded portion 74 of the sheets of Z-folded documents 71. The air is blown into the unfolding space 34 from a pair of side blowers 33, whereby the air is further blown in between the Z-folded document 72 and the Z-folded documents 76 of the sheets of Z-folded documents 71. Since the air is blown in between the Z-folded document 72 and the Z-folded documents 76 of the sheets of Z-folded documents 71, the Z-folded document 72 is easily separated from the Z-folded documents 76.

Figure 23:
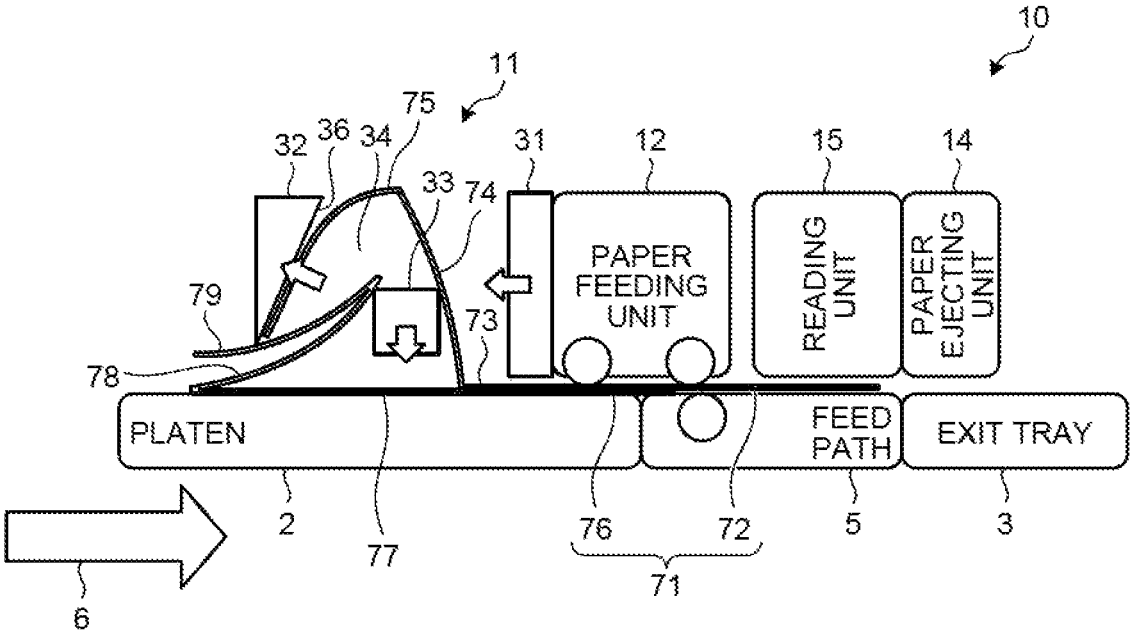
FIG. 23 is a side view schematically illustrating the unfolding unit of the document feeder in the first embodiment when the second folded portion of the sheets of Z-folded documents is held by the suction blower.

Since the suction blower 32 sucks the air from the unfolding space 34, the second folded portion 75 of the sheets of Z-folded documents 71 is held by the suction blower 32, as illustrated in FIG. 23. FIG. 23 is a side view schematically illustrating the unfolding unit 11 of the document feeder in the first embodiment when the second folded portion 75 of the sheets of Z-folded documents 71 is held by the suction blower 32. The Z-folded document 72 is separated from the Z-folded documents 76 by the separation roller 22 and the brake roller 23 and conveyed to the downstream side in the conveyance direction 6.

Figure 24:
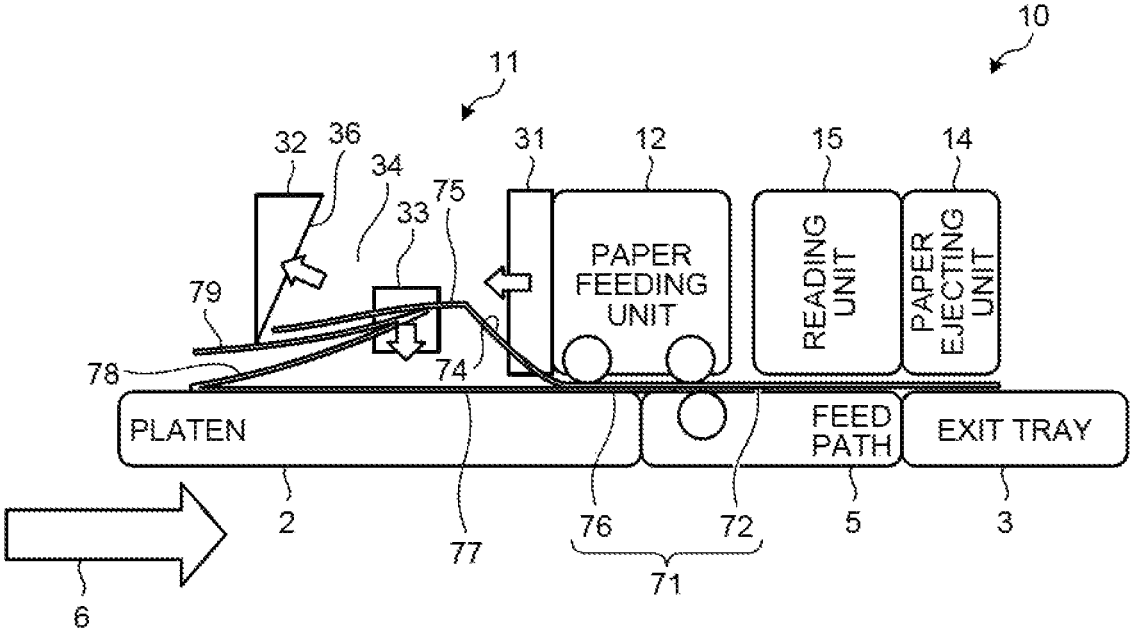
FIG. 24 is a side view schematically illustrating the unfolding unit of the document feeder in the first embodiment when the second folded portion of the sheets of Z-folded documents separates from the suction blower.

The second folded portion 75 separates from the suction blower 32 as the Z-folded document 72 is conveyed to the downstream side in the conveyance direction 6, as illustrated in FIG. 24. FIG. 24 is a side view schematically illustrating the unfolding unit 11 of the document feeder in the first embodiment when the second folded portion 75 of the sheets of Z-folded documents 71 separates from the suction blower 32. The second folded portion 75 separates from the suction blower 32, whereby the Z-folded document 72 is unfolded substantially flat and supplied by the paper feeding unit 12 to the paper ejecting unit 14.

Among the sheets of Z-folded documents 76, the Z-folded document on the top is unfolded and supplied by the paper feeding unit 12 to the paper ejecting unit 14, in the same manner as the Z-folded document 72. That is, each of the sheets of Z-folded documents 71 is unfolded and conveyed in the same manner as the Z-folded document 72, whereby the sheets of Z-folded documents 71 are supplied one by one to the paper ejecting unit 14 by the paper feeding unit 12. The image reading apparatus 10 can prevent buckling of the Z-folded document 72 by appropriately unfolding and conveying the Z-folded document 72 without heavily deforming a portion other than the creases, in the same manner as the Z-folded document 41. The image reading apparatus 10 thus can prevent buckling of each of the sheets of Z-folded documents 71 when the sheets of Z-folded documents 71 are unfolded and conveyed one by one.

Effects of Document Feeder in First Embodiment

The document feeder in the first embodiment includes the platen 2, the suction blower 32, the lifting blower 31, a pair of side blowers 33, and the paper feeding unit 12. The platen 2 has the placement surface 4. The suction blower 32 sucks the air from the unfolding space 34 formed between the platen 2 and the suction surface 36 and holds a part of a document placed on the placement surface 4 on the suction surface 36. The lifting blower 31 and a pair of side blowers 33 blow the air into the unfolding space 34. The paper feeding unit 12 conveys a document to the downstream side in the conveyance direction 6 along the placement surface 4. The suction surface 36 is inclined relative to the placement surface 4 such that the unfolding space 34 is narrower toward the upstream side of the conveyance direction 6.

Such a document feeder can unfold the Z-folded document 41 by conveying the front end portion 46 of the Z-folded document 41 to the downstream side in the conveyance direction 6 such that the second folded portion 49 of the Z-folded document 41 separates from the suction surface 36 after the second folded portion 49 is held by the suction surface 36. Since the suction surface 36 is inclined relative to the placement surface 4, the document feeder can reduce the degree of deformation of a portion other than the creases of the Z-folded document 41 when unfolding the Z-folded document 41. By reducing the degree of deformation of the Z-folded document 41, the document feeder can prevent buckling of the Z-folded document 41 and appropriately unfold and convey the Z-folded document 41.

The document feeder in the first embodiment has the downstream air-flow opening 38 that blows the air toward the unfolding space 34 from the downstream side in the conveyance direction 6. Such a document feeder can blow the air in between the front end portion 46 and the first folded portion 48 of the Z-folded document 41 with high efficiency and can bring the second folded portion 49 closer to the suction surface 36 and appropriately hold the second folded portion 49 along the suction surface 36.

When a plurality of documents are placed on the platen 2, the paper feeding unit 12 of the document feeder in the first embodiment conveys one document separated from the documents to the downstream side. Such a document feeder can unfold the Z-folded documents 71 one by one and convey the unfolded document to the downstream side in the conveyance direction 6.

The document feeder in the first embodiment further includes the first side air-flow opening 37-1 and the second side air-flow opening 37-2 that blow the air into the unfolding space 34 from both sides in the width direction 50 normal to the conveyance direction 6. Such a document feeder can blow the air in between the front end portion 46 and the first folded portion 48 of the Z-folded document 41 with high efficiency. Such a document feeder can further blow the air in between the Z-folded document 72 of the Z-folded documents 71 and the Z-folded documents 76 with high efficiency and can appropriately unfold the Z-folded documents 71 one by one and convey the unfolded document to the downstream side in the conveyance direction 6.

Second Embodiment

Figure 25:
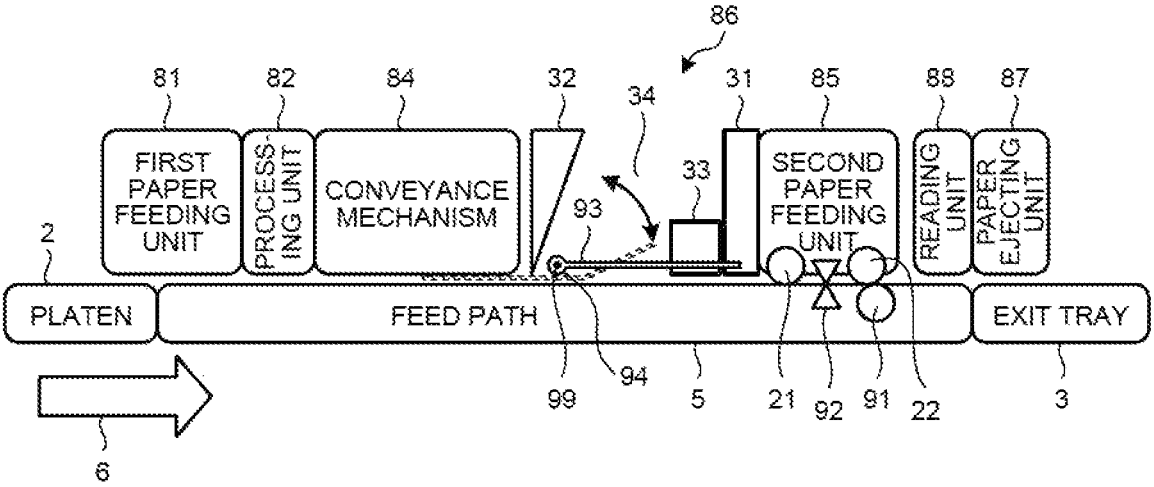
FIG. 25 is a side view schematically illustrating the image reading apparatus provided with the document feeder in a second embodiment.

FIG. 25 is a side view schematically illustrating the image reading apparatus provided with the document feeder in a second embodiment. The document feeder in the second embodiment is used in an image reading apparatus and includes the platen 2, the exit tray 3, and the feed path 5 as illustrated in FIG. 25, in the same manner as the document feeder in the foregoing first embodiment. The document feeder in the second embodiment includes a first paper feeding unit 81, a processing unit 82, a conveyance mechanism 84, a second paper feeding unit 85, an unfolding unit 86, a paper ejecting unit 87, and a reading unit 88. The first paper feeding unit 81 is disposed at an end on the platen 2 side on the feed path 5. The first paper feeding unit 81 detects whether a document is placed on the platen 2. When a plurality of documents are placed on the platen 2, the first paper feeding unit 81 releases one document disposed on the top of the documents placed on the platen 2, to the feed path 5, and supplies the document released from the platen 2 to the feed path 5 to the processing unit 82. When one document is placed on the platen 2, the first paper feeding unit 81 releases the document to the feed path 5 and supplies the document released from the platen 2 to the feed path 5 to the processing unit 82.

The processing unit 82 is disposed on the downstream side of the first paper feeding unit 81 on the feed path 5, that is, disposed between the first paper feeding unit 81 and the exit tray 3 on the feed path 5. The processing unit 82 detects whether the document supplied from the first paper feeding unit 81 is a one-sheet document or a bound document. The one-sheet document is formed of one sheet of paper. The bound document is formed by binding a plurality of sheets with a binder member. An example of the binder member is a staple.

When it is detected that the document supplied from the first paper feeding unit 81 is a one-sheet document, the processing unit 82 supplies the one-sheet document as it is to the conveyance mechanism 84. When it is detected that the document is a bound document, the processing unit 82 removes the binder member from the bound document to generate a plurality of one-sheet documents and supplies the generated one-sheet documents to the conveyance mechanism 84. The processing unit 82 may be unable to remove the binder member from the bound document in some cases. The processing unit 82 detects whether the binder member has been removed appropriately from the bound document and, when it is detected that the binder member has not been removed from the bound document, supplies the bound document as it is to the conveyance mechanism 84.

The conveyance mechanism 84 is disposed in a region on the downstream side of the processing unit 82 on the feed path 5, that is, disposed between the processing unit 82 and the exit tray 3 on the feed path 5. The conveyance mechanism 84 supplies the document supplied from the processing unit 82 to the second paper feeding unit 85.

The second paper feeding unit 85 is disposed on the downstream side of the conveyance mechanism 84 on the feed path 5, that is, disposed between the conveyance mechanism 84 and the exit tray 3 on the feed path 5. In the second paper feeding unit 85, the brake roller 23 of the paper feeding unit 12 previously described is replaced by another brake roller 91 and a document detection sensor 92 is added, and the other part is the same as the paper feeding unit 12 previously described. The pick roller 21 of the second paper feeding unit 85 is switched to the load mode or the distant mode. When switched to the load mode, the pick roller 21 rotates to bring a document in contact with the pick roller 21, among a plurality of documents supplied from the conveyance mechanism 84, into contact with the separation roller 22. When switched to the distant mode, the pick roller 21 retracts from the platen 2 so as not to come into contact with the document supplied from the conveyance mechanism 84. The separation roller 22 of the second paper feeding unit 85 rotates to convey the document in contact with the separation roller 22 to the downstream side in the conveyance direction 6.

The brake roller 91 is disposed on the downstream side of the pick roller 21 on the feed path 5, that is, disposed between the pick roller 21 and the exit tray 3 on the feed path 5. The brake roller 91 is switched to a separation force mode or a no separation force mode. In a case where the brake roller 91 is switched to the separation force mode, when one sheet of document is sandwiched between the separation roller 22 and the brake roller 23, the brake roller 91 follows one sheet of document conveyed by the separation roller 22 to rotate forward. In a case where the brake roller 91 is switched to the separation force mode, when a plurality of sheets of documents are sandwiched between the separation roller 22 and the brake roller 23, the brake roller 91 rotates backward. In a case where the brake roller 91 is switched to the no separation force mode, when a document is sandwiched between the separation roller 22 and the brake roller 23, the brake roller 91 follows the document conveyed by the separation roller 22 to rotate forward.

The document detection sensor 92 is disposed between the pick roller 21 and the separation roller 22 on the feed path 5. The document detection sensor 92 detects whether a document is disposed at a predetermined position between the pick roller 21 and the separation roller 22 on the feed path 5.

In the unfolding unit 86, an open/closed guide 93 and an open/closed guide driver 94 are added to the unfolding unit 11 of the document feeder in the foregoing first embodiment, and the other part is the same as the unfolding unit 11 of the document feeder in the foregoing first embodiment. The open/closed guide 93 is rotatably supported about a rotation axis 99 so as to be disposed in an open position or a closed position. The rotation axis 99 is parallel to the width direction 50. The open/closed guide driver 94 rotates the open/closed guide 93 about the rotation axis 99.

Figure 26:
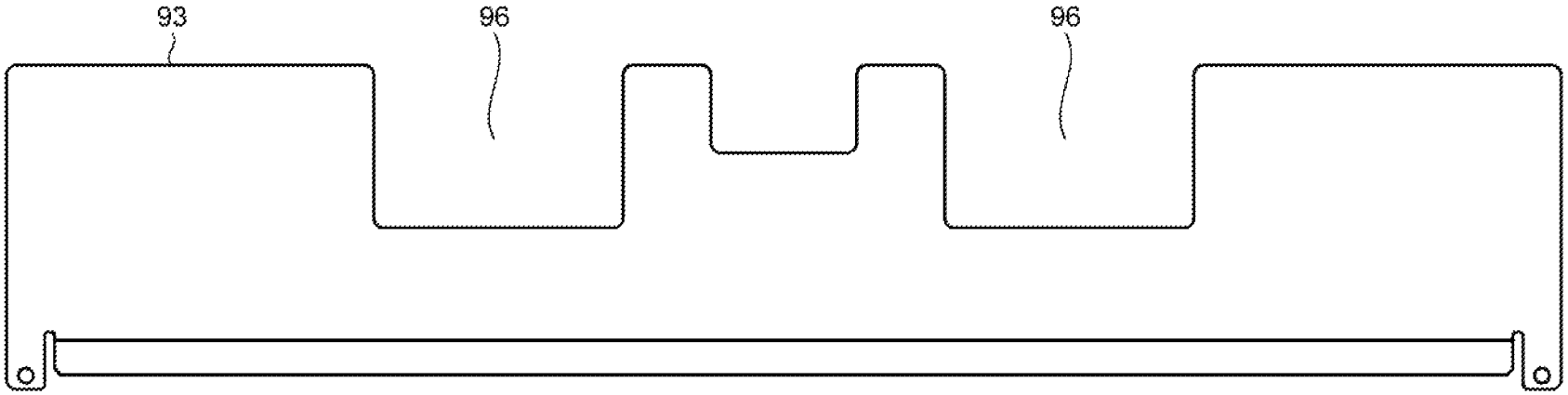
FIG. 26 is a plan view illustrating an open/closed guide of the document feeder in the second embodiment.

FIG. 26 is a plan view illustrating the open/closed guide 93 of the document feeder in the second embodiment. The open/closed guide 93 is formed in a substantially flat plate shape. The open/closed guide 93 has a plurality of notches 96.

Figure 27:
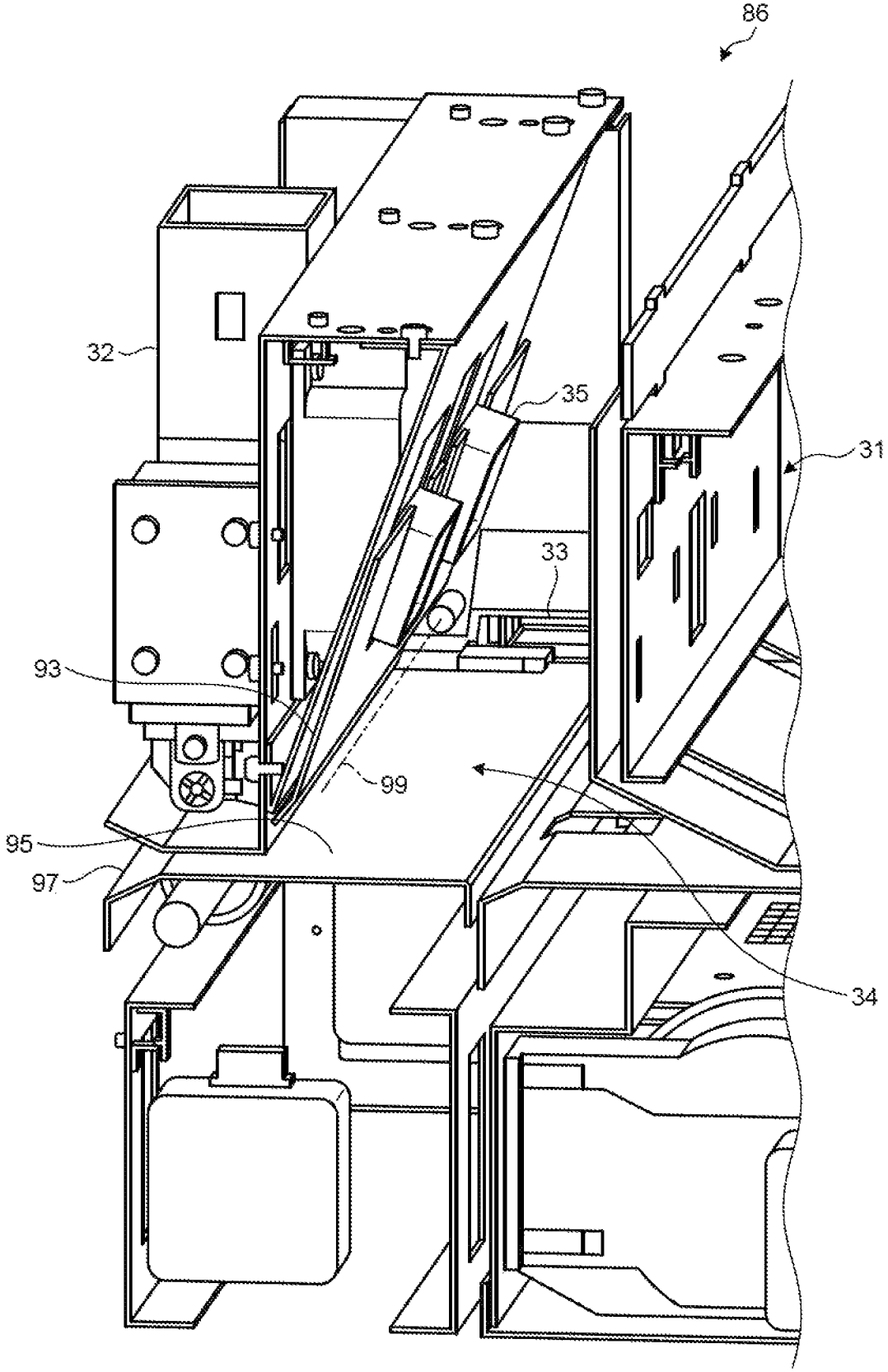
FIG. 27 is a perspective view illustrating the unfolding unit of the document feeder in the second embodiment when the open/closed guide is disposed in an open position.

As illustrated in FIG. 27, the feed path 5 includes a document placement member 97. FIG. 27 is a perspective view illustrating the unfolding unit 86 of the document feeder in the second embodiment when the open/closed guide 93 is disposed in the open position. The document placement member 97 has a substantially flat placement surface 95. The document placement member 97 is disposed below the unfolding unit 86 such that the feed path 5 is formed between the document placement member 97 and the unfolding unit 86. Further, the document placement member 97 is disposed such that a plane along the placement surface 95 is parallel to the conveyance direction 6 and the width direction 50 and such that the placement surface 95 faces the unfolding space 34 of the unfolding unit 86.

Figure 28:
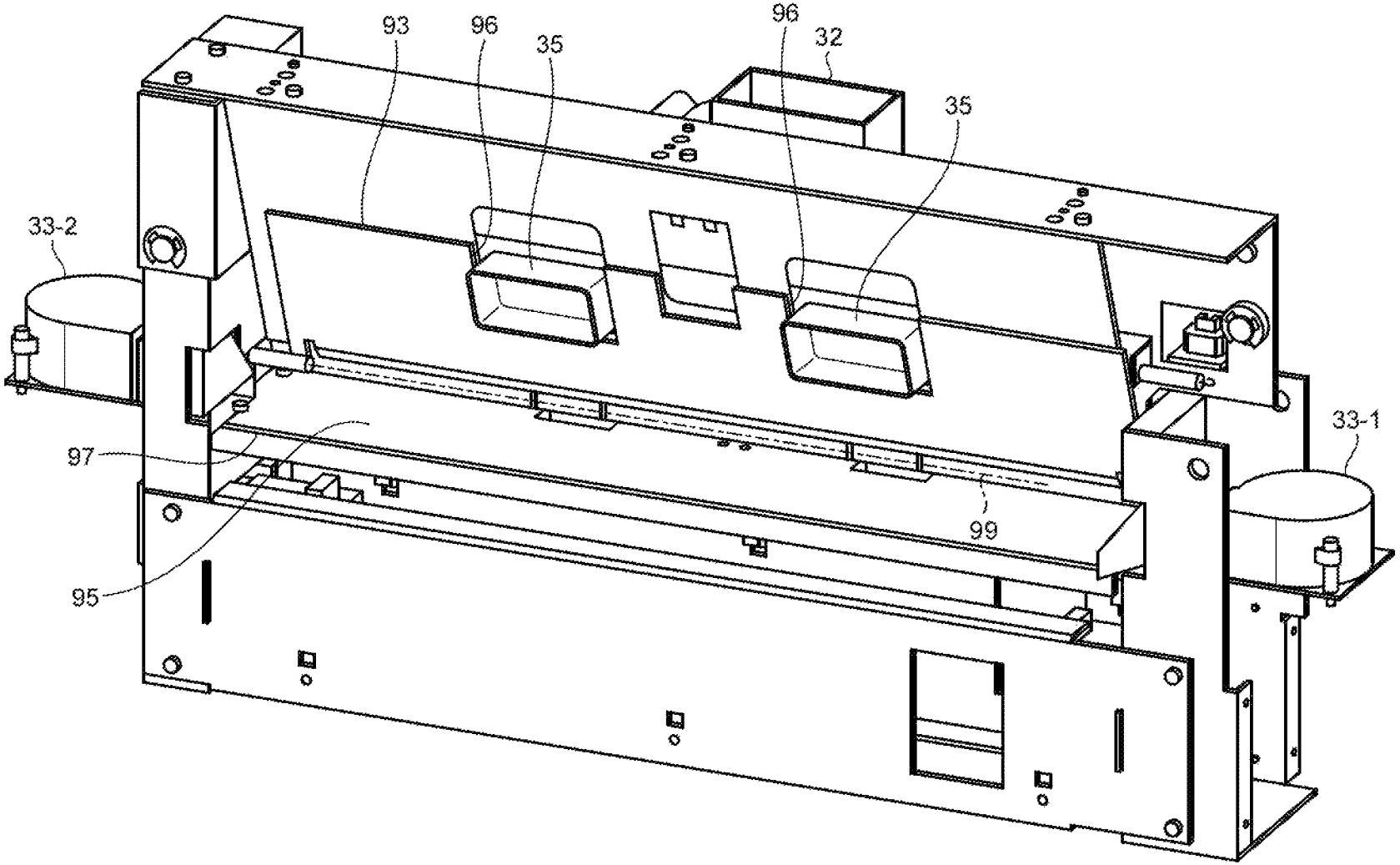
FIG. 28 is another perspective view illustrating the unfolding unit of the document feeder in the second embodiment when the open/closed guide is disposed in the open position.

When disposed in the open position, the open/closed guide 93 is disposed in the vicinity of the suction blower 32. FIG. 28 is another perspective view illustrating the unfolding unit 86 of the document feeder in the second embodiment when the open/closed guide 93 is disposed in the open position. When the open/closed guide 93 is disposed in the open position, the notches 96 are fitted in a plurality of air intakes 35 of the suction blower 32. Since the notches 96 are fitted in the air intakes 35, the open/closed guide 93 can be disposed on the upstream side in the conveyance direction 6 of the air intakes 35 of the suction blower 32, that is, can be disposed on the upstream side in the conveyance direction 6 from the suction surface 36. When the open/closed guide 93 is disposed on the upstream side in the conveyance direction 6 from the suction surface 36, the folded document conveyed on the feed path 5 can be unfolded in the unfolding space 34 of the unfolding unit 86 without coming into contact with the open/closed guide 93.

Figure 29:
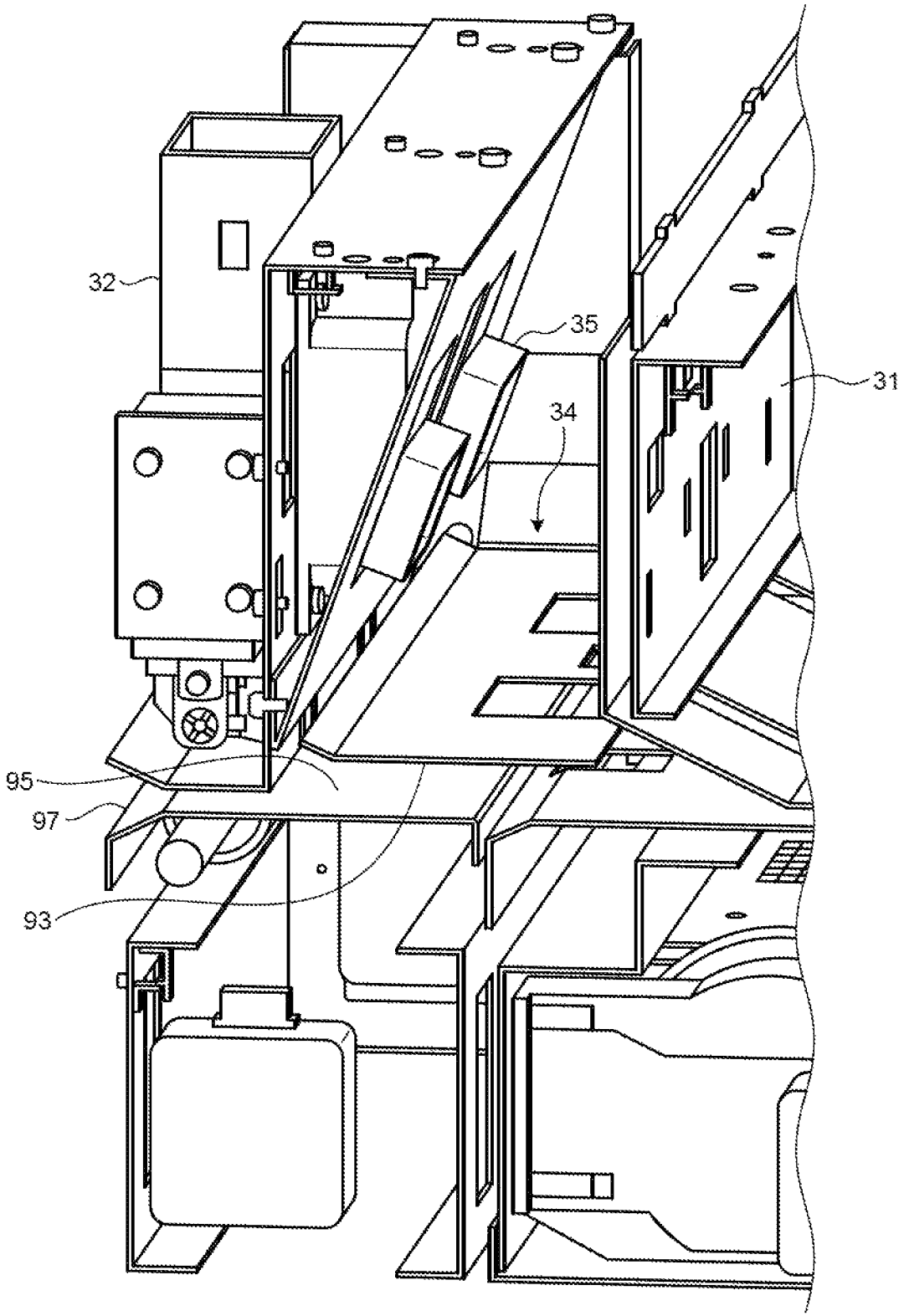
FIG. 29 is a perspective view illustrating the unfolding unit of the document feeder in the second embodiment when the open/closed guide is disposed in a closed position.

FIG. 29 is a perspective view illustrating the unfolding unit 86 of the document feeder in the second embodiment when the open/closed guide 93 is disposed in the closed position. When disposed in the closed position, the open/closed guide 93 is disposed in the vicinity of the placement surface 95 of the document placement member 97 such that a plane along the open/closed guide 93 is parallel to the conveyance direction 6 and the width direction 50. That is, when disposed in the closed position, the open/closed guide 93 isolates the unfolding space 34 from the path of a document formed by the feed path 5.

Figure 30:
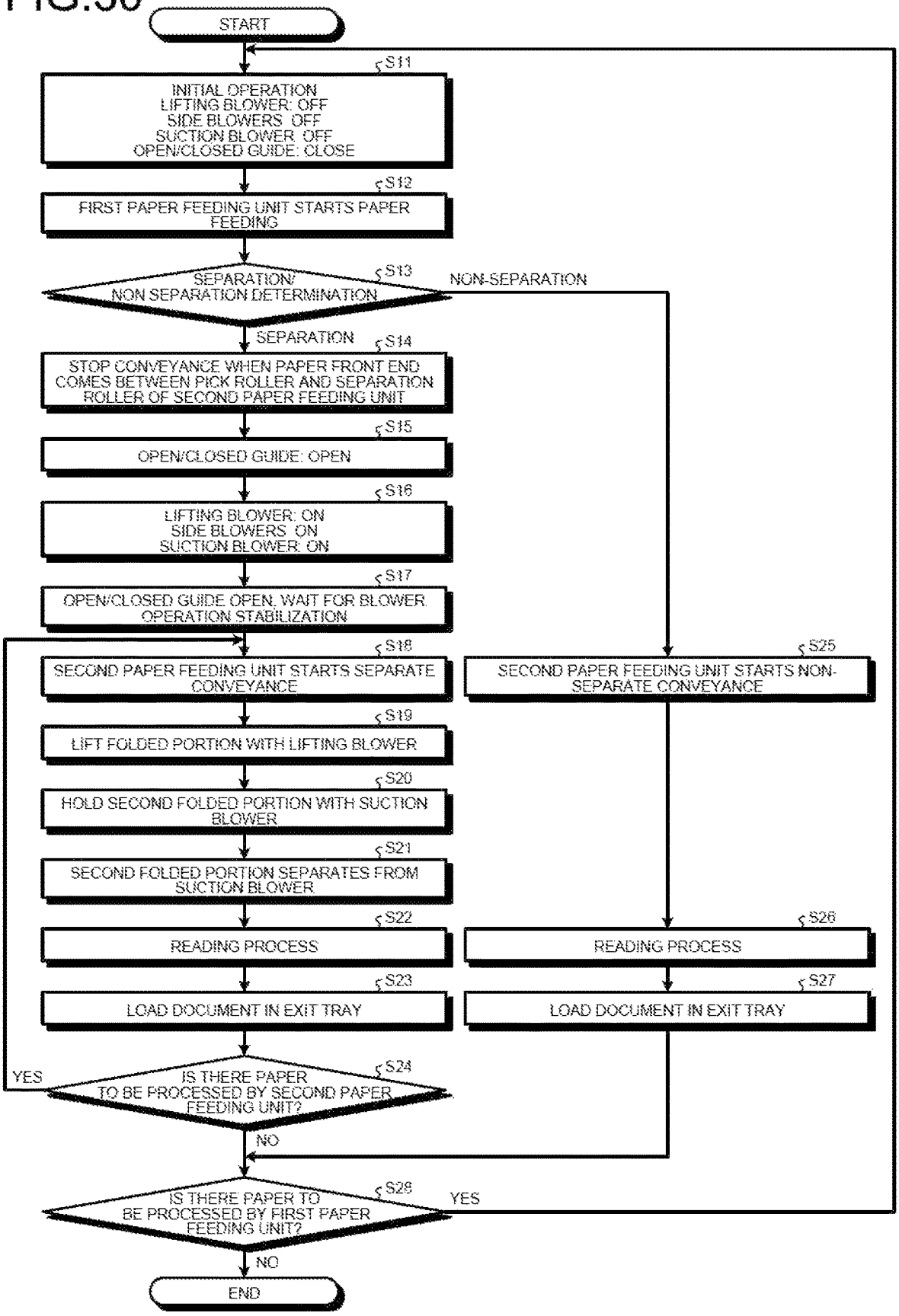
FIG. 30 is a flowchart illustrating the operation of the image reading apparatus provided with the document feeder in the second embodiment.

FIG. 30 is a flowchart illustrating the operation of the image reading apparatus provided with the document feeder in the second embodiment. To read an image from a plurality of documents using the image reading apparatus, the user places the documents on the platen 2 and operates the input/output device of the control unit of the image reading apparatus to start the image reading apparatus. The documents placed on the platen 2 include a one-sheet document or a bound document. The one-sheet document may be a Z-folded document that is Z-folded. Upon starting of the image reading apparatus, the control unit starts an initial operation (step S11). Upon starting of the initial operation, the control unit stops the operation of the lifting blower 31, the suction blower 32, and a pair of side blowers 33 and further controls the open/closed guide driver 94 to dispose the open/closed guide 93 into the closed position.

After the initial operation is performed, the control unit controls the first paper feeding unit 81 to detect whether a document is placed on the platen 2. When it is detected that a document is placed on the platen 2, the control unit controls the first paper feeding unit 81 to release one document disposed on the top of the documents placed on the platen 2, to the feed path 5, and supplies the released document to the processing unit 82 (step S12).

The control unit further controls the processing unit 82 to detect whether the document supplied from the first paper feeding unit 81 is a bound document or a one-sheet document. When it is detected that the document supplied from the first paper feeding unit 81 is a bound document, the control unit controls the processing unit 82 to remove a binder member from the bound document. The control unit further controls the processing unit 82 to detect whether the binder member has been removed appropriately from the bound document. When the binder member has been removed appropriately from the bound document, the control unit controls the processing unit 82 to supply a plurality of one-sheet documents from which the binder member has been removed appropriately, to the conveyance mechanism 84. When the binder member is not removed appropriately from the bound document, the control unit controls the processing unit 82 to supply the bound document as it is to the conveyance mechanism 84. When it is detected that the document supplied from the first paper feeding unit 81 is a one-sheet document, the control unit controls the processing unit 82 to supply the one-sheet document as it is to the conveyance mechanism 84.

The control unit switches to the separation mode or the non-separation mode in accordance with the operation of the processing unit 82 (step S13). That is, the control unit switches to the separation mode when the processing unit 82 has removed a binder member appropriately from the bound document or when the one-sheet document has been supplied from the first paper feeding unit 81 to the processing unit 82. The control unit switches to the non-separation mode when the processing unit 82 has not removed a binder member appropriately from the bound document.

When switching to the separation mode (separation at step S13), the control unit controls the document detection sensor 92 to detect whether the document is disposed at a predetermined position between the pick roller 21 and the brake roller 91. When it is detected that the document is disposed at a predetermined position between the pick roller 21 and the brake roller 91, the control unit controls the conveyance mechanism 84 to stop conveyance of the document (step S14). After conveyance of the document is stopped, the control unit controls the open/closed guide driver 94 to dispose the open/closed guide 93 into the open position (step S15). After conveyance of the document is stopped, the control unit further controls the lifting blower 31 to blow the air into the unfolding space 34, controls a pair of side blowers 33 to blow the air into the unfolding space 34 from both sides in the width direction 50, and controls the suction blower 32 to suck the air from the unfolding space 34 (step S16).

The control unit waits until a timing when a predetermined period has passed since the timing when the lifting blower 31, the suction blower 32, a pair of side blowers 33, and the open/closed guide driver 94 start operation (step S17). The predetermined period is, for example, one second. With passage of a predetermined period, the lifting blower 31 can stably blow the air into the unfolding space 34. With passage of a predetermined period, the suction blower 32 can stably suck the air from the unfolding space 34. With passage of a predetermined period, a pair of side blowers 33 can stably blow the air into the unfolding space 34. With passage of a predetermined period, the open/closed guide driver 94 can reliably dispose the open/closed guide 93 into the open position.

After a predetermined period has passed, the control unit starts separate conveyance (step S18). Upon starting of separate conveyance, the control unit switches the conveyance mechanism 84 to the distant mode, switches the pick roller 21 to the load mode, and switches the brake roller 91 to the separation force mode. The control unit allows the pick roller 21 to rotate forward so that the document in contact with the pick roller 21 is conveyed to the downstream side in the conveyance direction 6 so as to be sandwiched between the separation roller 22 and the brake roller 91. The control unit allows the separation roller 22 to rotate forward so that the document disposed on the top of a plurality of documents sandwiched between the separation roller 22 and the brake roller 91 is supplied to the paper ejecting unit 87.

In a case where the brake roller 91 is switched to the separation force mode, when one sheet of document is sandwiched between the separation roller 22 and the brake roller 91, the brake roller 91 follows the one sheet of document conveyed to rotate forward and conveys the one sheet of document as it is to the paper ejecting unit 87, and when a plurality of sheets of documents are sandwiched between the separation roller 22 and the brake roller 91, the brake roller 91 rotates backward to convey the document not in contact with the separation roller 22 to the upstream side in the conveyance direction 6. That is, upon starting of separation conveyance, the second paper feeding unit 85 supplies the documents supplied from the conveyance mechanism 84 one by one to the paper ejecting unit 87.

When a folded document is conveyed between the conveyance mechanism 84 and the second paper feeding unit 85 on the feed path 5, the unfolding unit 86 unfolds the folded document in the same manner as the unfolding unit 11 of the document feeder in the foregoing first embodiment. For example, when the folded portion 47 of the Z-folded document 41 is disposed in the unfolding space 34, the air is blown into the unfolding space 34 from the lifting blower 31, whereby the air is blown in between the front end portion 46 and the first folded portion 48. The air is blown into the unfolding space 34 from a pair of side blowers 33, whereby the air is further blown in between the front end portion 46 and the first folded portion 48 of the Z-folded document 41. The air blown in between the front end portion 46 and the first folded portion 48 lifts the folded portion 47 of the Z-folded document 41 from the front end portion 46 (step S19).

Since the suction blower 32 sucks the air from the unfolding space 34, the second folded portion 49 of the Z-folded document 41 is held along the suction surface 36 by the suction blower 32 when the folded portion 47 is lifted from the front end portion 46 (step S20). After being held by the suction blower 32, the second folded portion 49 of the Z-folded document 41 separates from the suction surface 36 as the Z-folded document 41 is further conveyed by the second paper feeding unit 85 to the downstream side in the conveyance direction 6 (step S21). The second folded portion 49 separates from the suction surface 36, whereby the Z-folded document 41 is unfolded substantially flat. The unfolding unit 86 can prevent buckling of the Z-folded document 41 in the same manner as the unfolding unit 11 of the document feeder in the foregoing first embodiment.

When the document is supplied from the second paper feeding unit 85 to the paper ejecting unit 87, the control unit controls the reading unit 88 to read images on both surfaces of the document conveyed from the second paper feeding unit 85 to the paper ejecting unit 87 and record the read images (step S22). The control unit controls the paper ejecting unit 87 to place the document supplied from the brake roller 91 to the paper ejecting unit 87 onto the exit tray 3 (step S23).

The control unit controls the document detection sensor 92 to detect whether a document is disposed at a predetermined position between the pick roller 21 and the brake roller 91 (step S24). When it is detected that a document is disposed at a predetermined position between the pick roller 21 and the brake roller 91 (Yes at step S24), the control unit repeatedly performs the process from step S18 to step S24. The process from step S18 to step S24 is repeatedly performed, whereby a plurality of one-sheet documents generated by the processing unit 82 removing a binder member from the bound document are unfolded one by one, have images read therefrom, and are placed onto the exit tray 3.

When switched to the non-separation mode (non-separation at step S13), the control unit starts non-separate conveyance (step S25). Upon starting of non-separate conveyance, the control unit switches the pick roller 21 to the distant mode and switches the brake roller 91 to the no separation force mode while the conveyance mechanism 84 is kept switched to the load mode and the open/closed guide 93 is kept disposed in the closed position. The control unit controls the conveyance mechanism 84 to supply the bound document supplied from the processing unit 82 to the conveyance mechanism 84 to the second paper feeding unit 85.

When the open/closed guide 93 is disposed in the closed position, the front end of the bound document does not enter the unfolding space 34, and the bound document is supplied appropriately to the second paper feeding unit 85. In the document feeder, in a case where the bound document is supplied to the second paper feeding unit 85, when the front end of the bound document enters the unfolding space 34, the front end may be caught, for example, by a member of the unfolding unit 86 to cause breakage of the bound document or cause occurrence of inconvenience such as a jam. The document feeder, provided with the open/closed guide 93, can guide the bound document appropriately to the second paper feeding unit 85 and prevent occurrence of such inconvenience.

When the open/closed guide 93 is disposed in the closed position and the lifting blower 31, the suction blower 32, and a pair of side blowers 33 are not in operation, the bound document, even folded, is supplied to the second paper feeding unit 85 without being unfolded by the unfolding unit 86. The bound document is guided by the open/closed guide 93 and supplied to the second paper feeding unit 85, and then sandwiched between the separation roller 22 and the brake roller 91. With the brake roller 91 being switched to the no separation force mode, the bound document sandwiched between the separation roller 22 and the brake roller 91 is supplied to the paper ejecting unit 87 without being separated when the separation roller 22 rotates forward.

When the bound document is supplied from the second paper feeding unit 85 to the paper ejecting unit 87, the control unit controls the reading unit 88 to read images on both surfaces of the bound document and record the read images (step S26). The control unit controls the paper ejecting unit 87 to place the bound document onto the exit tray 3 (step S27).

After the bound document is placed onto the exit tray 3, the control unit controls the first paper feeding unit 81 to detect whether a document is placed on the platen 2 (step S28). Even when it is detected that no document is disposed at a predetermined position between the pick roller 21 and the brake roller 91 (No at step S24), the control unit detects whether a document is placed on the platen 2, similarly. When it is detected that a document is placed on the platen 2 (Yes at step S28), the control unit repeatedly performs the process from step S11 to step S28. The process from step S11 to step S28 is repeatedly performed, whereby the documents placed on the platen 2 have images read therefrom and are placed onto the exit tray 3.

Effects of Document Feeder in Second Embodiment

The document feeder in the second embodiment includes the open/closed guide 93 movable between the closed position and the open position. When disposed in the closed position, the open/closed guide 93 guides a document to the second paper feeding unit 85, and when disposed in the open position, the open/closed guide 93 retracts such that a part of the document is movable toward the suction surface 36. Such a document feeder can prevent breakage of a bound document or occurrence of inconvenience such as a jam since the open/closed guide 93 is disposed in the closed position when the bound document passes through the unfolding unit 86.

The document feeder in the second embodiment further includes the open/closed guide driver 94 to move the open/closed guide 93 to the closed position or the open position. Such a document feeder can automatically dispose the open/closed guide 93 into the closed position or automatically dispose the open/closed guide 93 into the open position.

Although the document feeder in the second embodiment includes the open/closed guide driver 94, the open/closed guide driver 94 may be omitted. In this case, when a document is unfolded by the unfolding unit 86, the open/closed guide 93 is disposed into the open position by the user, and when a document is not unfolded by the unfolding unit 86, the open/closed guide 93 is disposed into the closed position by the user. Such a document feeder also can unfold and convey a folded document appropriately when the open/closed guide 93 is disposed in the open position, in the same manner as the document feeder in the foregoing embodiment.

Third Embodiment

Figure 31:
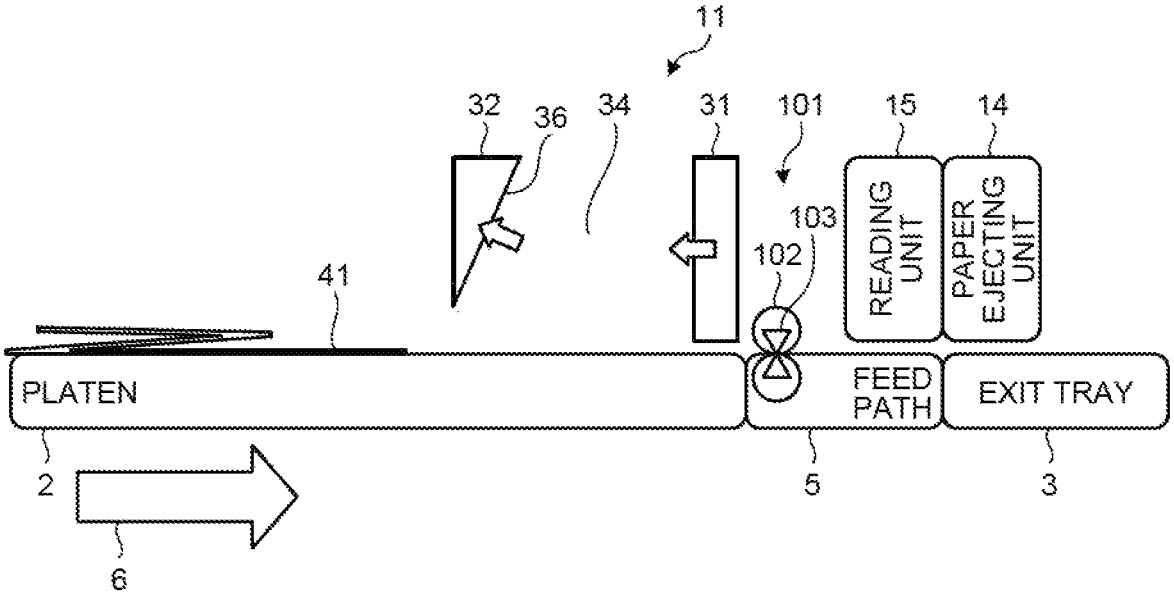
FIG. 31 is a side view schematically illustrating the image reading apparatus provided with the document feeder in a third embodiment.

The document feeder in the foregoing first embodiment separates the documents placed on the platen 2 from each other in the paper feeding unit 12. However, the documents are not necessarily separated. As illustrated in FIG. 31, in the document feeder in a third embodiment, the paper feeding unit 12 of the document feeder in the foregoing first embodiment is replaced by another paper feeding unit 101, and the other part is the same as the document feeder in the foregoing first embodiment. FIG. 31 is a side view schematically illustrating the image reading apparatus provided with the document feeder in the third embodiment. The paper feeding unit 101 includes a pair of conveyance rollers 102 and a document detection sensor 103. A pair of conveyance rollers 102 are proximate to each other such that a document is sandwiched between a pair of conveyance rollers 102. When a document is sandwiched between a pair of conveyance rollers 102, a pair of conveyance rollers 102 rotate to supply the document to the paper ejecting unit 14. The document detection sensor 103 detects whether a document is disposed between a pair of conveyance rollers 102.

Figure 32:
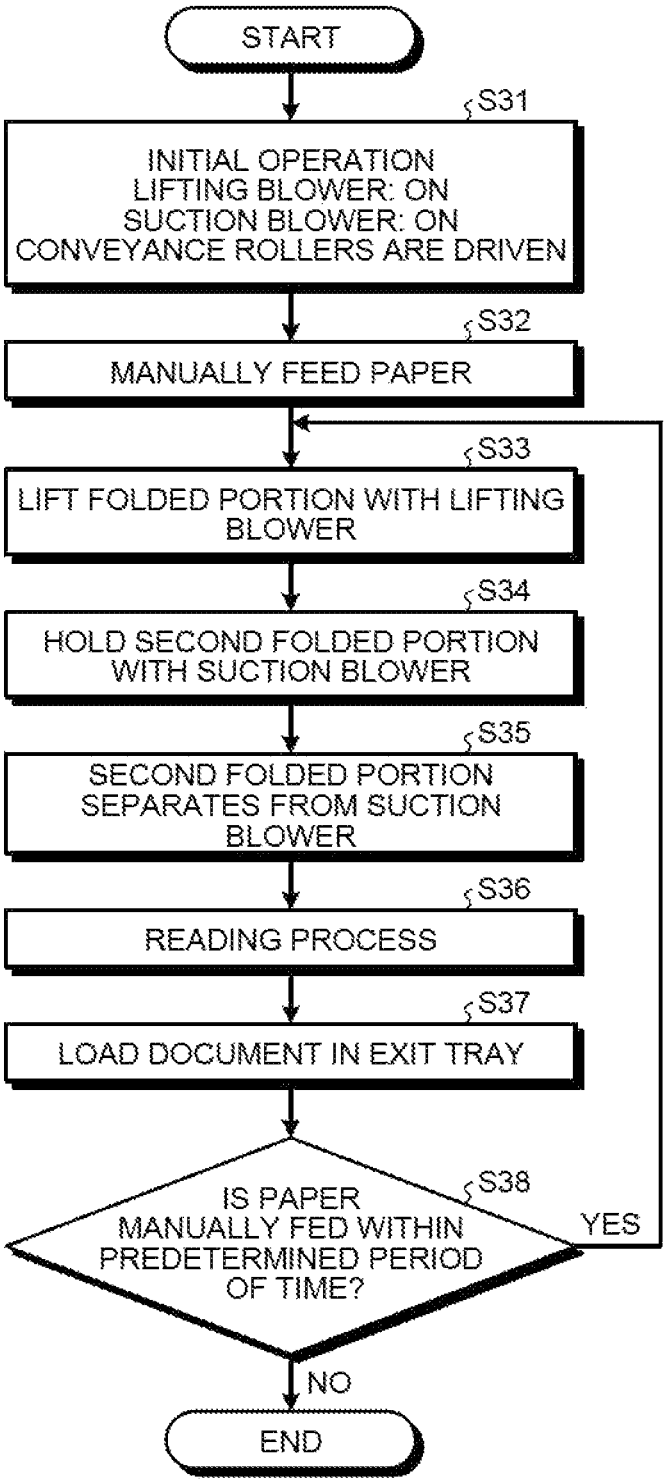
FIG. 32 is a flowchart illustrating the operation of the image reading apparatus provided with the document feeder in the third embodiment.

FIG. 32 is a flowchart illustrating the operation of the image reading apparatus provided with the document feeder in the third embodiment. To read an image from the Z-folded document 41 using the image reading apparatus, first, the user operates the input/output device of the control unit of the image reading apparatus to start the image reading apparatus. Upon starting of the image reading apparatus, the control unit of the document feeder in the third embodiment starts an initial operation (step S31). Upon starting of the initial operation, the control unit brings the lifting blower 31, the suction blower 32, and a pair of side blowers 33 into operation and allows a pair of conveyance rollers 102 to rotate. After the initial operation is performed, the user places the Z-folded document 41 onto the platen 2 such that the folded portion 47 of the Z-folded document 41 is disposed in the unfolding space 34 and such that the front end of the Z-folded document 41 is sandwiched between a pair of conveyance rollers 102 of the paper feeding unit 101 (step S32).

When the folded portion 47 of the Z-folded document 41 is disposed in the unfolding space 34, the air is blown into the unfolding space 34 from the lifting blower 31, whereby the air is blown in between the front end portion 46 and the first folded portion 48. The air is blown into the unfolding space 34 from a pair of side blowers 33, whereby the air is further blown in between the front end portion 46 and the first folded portion 48 of the Z-folded document 41. The air blown in between the front end portion 46 and the first folded portion 48 lifts the folded portion 47 of the Z-folded document 41 from the front end portion 46 (step S33).

Since the suction blower 32 sucks the air from the unfolding space 34, the second folded portion 49 of the Z-folded document 41 is held along the suction surface 36 by the suction blower 32 when the folded portion 47 is lifted from the front end portion 46 (step S34). After the second folded portion 49 of the Z-folded document 41 is held by the suction blower 32, the Z-folded document 41 is further conveyed by the paper feeding unit 101 to the downstream side in the conveyance direction 6, whereby the second folded portion 49 separates from the suction surface 36 (step S35). The second folded portion 49 separates from the suction surface 36, whereby the Z-folded document 41 is unfolded substantially flat.

When the document is supplied from the paper feeding unit 101 to the paper ejecting unit 14, the control unit controls the reading unit 15 to read images on both surfaces of the document conveyed from the paper feeding unit 101 to the paper ejecting unit 14 and record the read images (step S36). The control unit controls the paper ejecting unit 14 to place the document supplied from the paper feeding unit 101 to the paper ejecting unit 14 onto the exit tray 3 (step S37).

To read an image from another Z-folded document different from the Z-folded document 41, the user places the Z-folded document onto the platen 2 within a certain period of time from the timing when the Z-folded document 41 exits from between a pair of side blowers 33. The control unit controls the document detection sensor 103 to detect whether a document is disposed between a pair of conveyance rollers 102 within a period of time from the timing when the Z-folded document 41 exits from between a pair of side blowers 33 (step S38). When it is detected that a document is disposed between a pair of conveyance rollers 102 within a certain period of time (Yes at step S38), the control unit repeatedly performs the process from step S32 to step S38.

The document feeder in the third embodiment can prevent buckling of the Z-folded document 41 when unfolding and conveying the Z-folded document 41, in the same manner as the document feeder in the foregoing first embodiment. The document feeder in the third embodiment can unfold and convey a folded document other than the Z-folded document 41 and can prevent buckling of the folded document when unfolding and conveying the folded document, in the same manner as the document feeder in the foregoing first embodiment.

Fourth Embodiment

Figure 33:
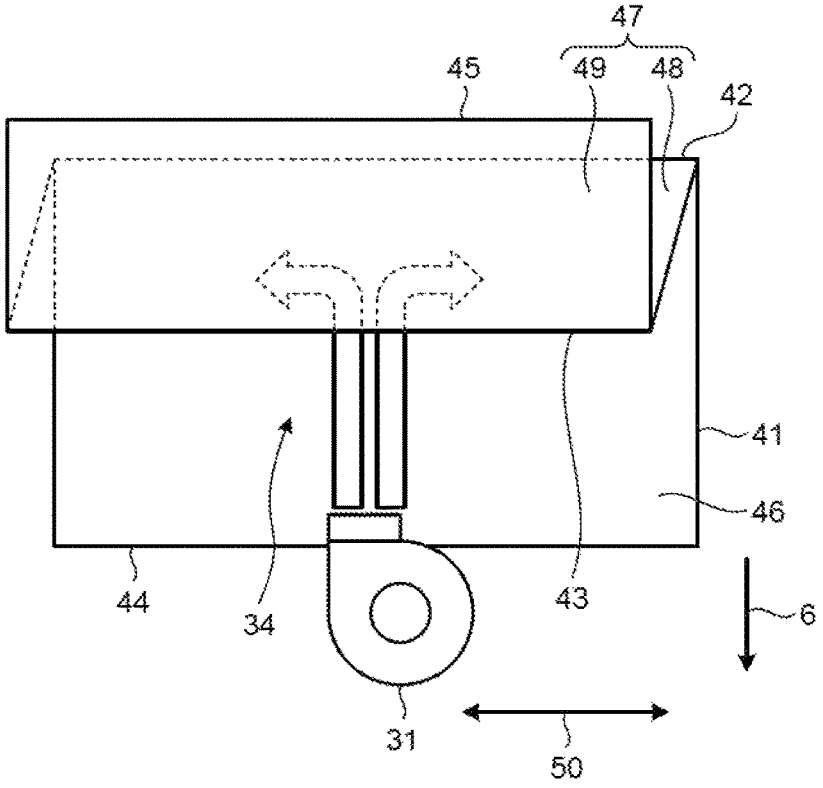
FIG. 33 is a top view illustrating a part of the unfolding unit of the document feeder in a fourth embodiment.

FIG. 33 is a top view illustrating a part of the unfolding unit of the document feeder in a fourth embodiment. In the unfolding unit of the document feeder in the fourth embodiment, a pair of side blowers 33 of the unfolding unit 11 of the document feeder in the foregoing first embodiment are omitted, and the other part is the same as the unfolding unit 11 of the document feeder in the foregoing first embodiment. The document feeder in the fourth embodiment can operate similarly to the document feeder in the foregoing first embodiment to prevent buckling of a folded document when unfolding and conveying the folded document, in the same manner as the document feeder in the foregoing first embodiment. Since a pair of side blowers 33 are omitted, the production cost of the document feeder in the fourth embodiment can be reduced compared with the document feeder in the foregoing first embodiment.

Since a pair of side blowers 33 are omitted in the document feeder in the fourth embodiment, much of the air blown in between the front end portion 46 and the first folded portion 48 of the Z-folded document 41 by the lifting blower 31 is ejected from the ends in the width direction 50. In the document feeder in the foregoing first embodiment, compared with the document feeder in the fourth embodiment, the air blown in between the front end portion 46 and the first folded portion 48 of the Z-folded document 41 is less ejected, so that the folded portion 47 can be lifted with high efficiency, and the Z-folded document 41 can be unfolded with high efficiency.

Fifth Embodiment

Figure 34:
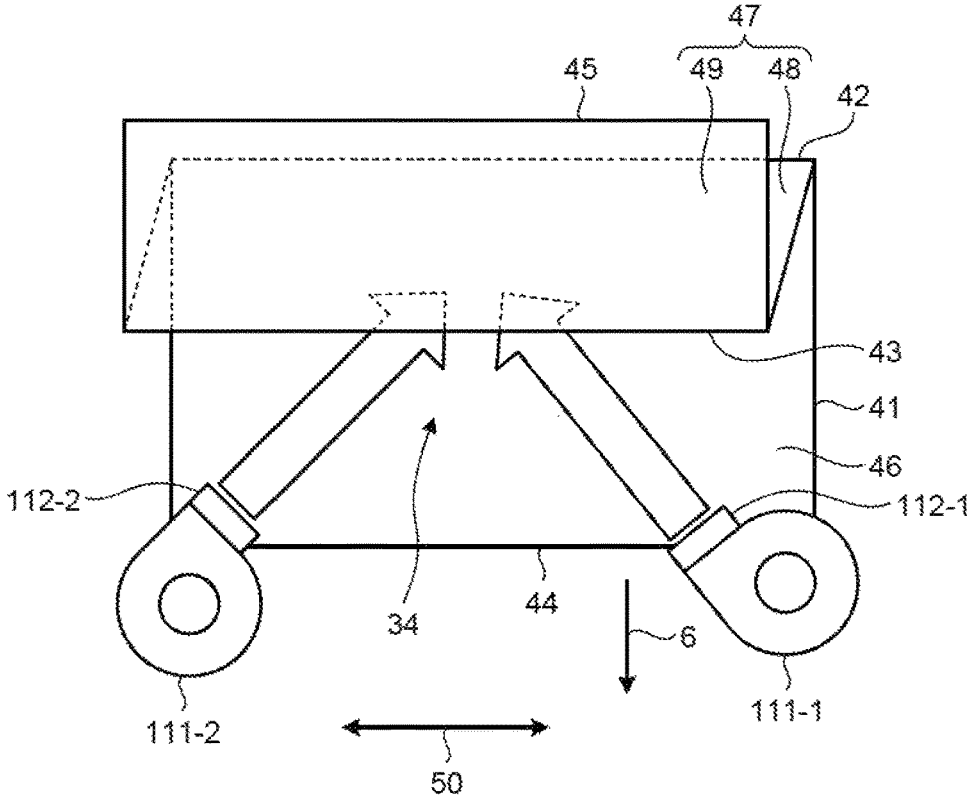
FIG. 34 is a top view illustrating a part of the unfolding unit of the document feeder in a fifth embodiment.

FIG. 34 is a top view illustrating a part of the unfolding unit of the document feeder in a fifth embodiment. In the document feeder in the fifth embodiment, the lifting blower 31 of the document feeder in the foregoing fourth embodiment is replaced by a first lifting blower 111-1 and a second lifting blower 111-2, and the other part is the same as the document feeder in the foregoing fourth embodiment. The first lifting blower 111-1 includes a first downstream air-flow opening 112-1 disposed on one side in the width direction 50 of the downstream side of the unfolding space 34 and blows the air toward the center in the width direction 50 of the unfolding space 34 through this first downstream air-flow opening 112-1. The second lifting blower 111-2 includes a second downstream air-flow opening 112-2 disposed on the other side in the width direction 50 of the downstream side of the unfolding space 34 and blows the air toward the center in the width direction 50 of the unfolding space 34 through this second downstream air-flow opening 112-2.

The document feeder in the fifth embodiment operates similarly to the document feeder in the foregoing fourth embodiment. At this time, the air blown out from the first downstream air-flow opening 112-1 and the air blown out from the second downstream air-flow opening 112-2 collide against each other at the center in the width direction 50 between the front end portion 46 and the first folded portion 48 of the Z-folded document 41. The air blown in between the front end portion 46 and the first folded portion 48 is therefore less ejected from between the front end portion 46 and the first folded portion 48. Since the air is less ejected from between the front end portion 46 and the first folded portion 48 of the Z-folded document 41, the document feeder in the fifth embodiment can lift the folded portion 47 with high efficiency and can unfold the Z-folded document 41 with high efficiency, compared with the document feeder in the foregoing fourth embodiment.

The unfolding units 11 and 86 of the document feeder in the foregoing embodiments are provided with a plurality of blowers, which may be replaced by one blower. For example, the document feeder has a plurality of shutters that open/close the downstream air-flow opening, the first side air-flow opening 37-1, the second side air-flow opening 37-2, and the air intakes 35. The downstream air-flow opening, the first side air-flow opening 37-1, the second side air-flow opening 37-2, and the air intakes 35 are connected to the one blower. Such a document feeder can operate similarly to the document feeder in the foregoing embodiments by opening and closing the shutters and can prevent buckling of a folded document when unfolding and conveying the folded document. The production cost of the document feeder can be reduced compared with the document feeder in the foregoing embodiments.

The document feeder in the foregoing embodiments is used for an image reading apparatus but may be used for other devices. An example of other devices is a printer. For example, when the document feeder is used for a printer, the reading unit 15 is replaced by a printing device. Even when the document feeder is used for other devices different from the image reading apparatus, a folded document can be unfolded and conveyed appropriately.

The document feeder of the disclosure can unfold and convey a folded document appropriately.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A document feeder comprising:

a document placement member that has a placement surface on which a document is placed;

a sucker that has a suction surface, the sucker being arranged on an upper side of the document placement member such that the placement surface faces the suction surface, the sucker sucking air from a space formed between the document placement member and the suction surface such that a first part of the document adheres to the suction surface of the sucker;

a blower that blows air into the space; and a paper feeder that:

while the first part of the document adheres to the suction surface, conveys a second part different from the first part of the document in a conveyance direction along the placement surface such that a crease formed between the first part and the second part is unfolded; and conveys the second part of the document in the conveyance direction such that the first part of the document separates from the suction surface, wherein the suction surface is inclined relative to the placement surface such that the space is narrower toward an upstream side in the conveyance direction.

2. The document feeder according to claim 1, wherein the blower has a downstream air-flow opening to blow air toward the space from a downstream side in the conveyance direction.

3. The document feeder according to claim 2, wherein the downstream air-flow opening includes a plurality of air-flow openings spaced apart in a width direction normal to the conveyance direction.

4. The document feeder according to claim 1, wherein the blower further includes a pair of air-flow openings to blow air into the space from both sides in a width direction normal to the conveyance direction.

5. The document feeder according to claim 1, further comprising an open/closed guide that is movable between a closed position and an open position, wherein when disposed in the closed position, the open/closed guide guides the document to the paper feeder, and when disposed in the open position, the open/closed guide retracts to allow a part of the document to be movable toward the suction surface.

6. The document feeder according to claim 5, further comprising a driver that moves the open/closed guide to the closed position or the open position.

7. The document feeder according to claim 1, wherein when the document includes a plurality of documents, the paper feeder conveys one document separated from the documents to a downstream side.

* * * * *